US008020714B2

(12) United States Patent
Miller, Jr. et al.

(10) Patent No.: US 8,020,714 B2
(45) Date of Patent: Sep. 20, 2011

(54) PRODUCT MERCHANDISING SYSTEM FOR WALK-IN DISPLAY COOLERS AND THE LIKE

(75) Inventors: Donald J. Miller, Jr., Belleville, IL (US); Robert E. Kreutzer, Jr., Columbia, IL (US); Andrew J. Boron, Belleville, IL (US); Sean W. Luaders, O'Fallon, MO (US)

(73) Assignee: Presence From Innovation, LLC, St. Louis, MO (US)

( * ) Notice: Subject to any disclaimer, the term of this patent is extended or adjusted under 35 U.S.C. 154(b) by 388 days.

(21) Appl. No.: 12/259,882

(22) Filed: Oct. 28, 2008

(65) Prior Publication Data

US 2009/0107938 A1 Apr. 30, 2009

Related U.S. Application Data

(60) Provisional application No. 60/984,037, filed on Oct. 31, 2007.

(51) Int. Cl.
*A47F 5/00* (2006.01)

(52) U.S. Cl. ..... 211/134; 211/189; 292/32; 292/163; 106/61; 106/107

(58) Field of Classification Search ..... 211/134, 211/186, 187, 188, 189, 190, 175, 184; 108/60, 108/61, 106, 107, 109, 147.11; 292/163, 292/171, 174, 175, DIG. 25, DIG. 63, 137, 292/32, 33, 38, 41, 42
See application file for complete search history.

(56) References Cited

U.S. PATENT DOCUMENTS

| | | | | | |
|---|---|---|---|---|---|
| 935,560 | A | * | 9/1909 | Stone | 211/184 |
| 1,553,821 | A | * | 9/1925 | Johnson | 108/38 |
| 1,938,126 | A | | 12/1933 | Thompson | |
| 2,953,258 | A | * | 9/1960 | Streit | 211/184 |
| 3,295,634 | A | | 1/1967 | Buchbinder | |
| 3,330,419 | A | | 7/1967 | Joseph | |
| 3,497,073 | A | | 2/1970 | Bartell | |
| 3,536,203 | A | | 10/1970 | Janetka | |
| 3,708,074 | A | | 1/1973 | Fahey et al. | |
| 3,885,846 | A | | 5/1975 | Chuang et al. | |
| 4,889,397 | A | * | 12/1989 | Ryan | 312/332.1 |
| 4,955,490 | A | * | 9/1990 | Schafer | 211/187 |
| 4,972,783 | A | * | 11/1990 | Crissman et al. | 108/107 |
| 5,072,839 | A | * | 12/1991 | Arnone | 211/187 |
| 5,088,607 | A | * | 2/1992 | Risafi et al. | 211/59.3 |
| 5,127,340 | A | * | 7/1992 | Maro et al. | 108/107 |
| 5,199,584 | A | | 4/1993 | Fowler et al. | |
| 5,217,122 | A | * | 6/1993 | Martinez | 211/43 |
| 5,349,909 | A | * | 9/1994 | Smit et al. | 108/107 |
| 5,490,600 | A | | 2/1996 | Bustos | |

(Continued)

*Primary Examiner* — Darnell Jayne
*Assistant Examiner* — Devin Barnett
(74) *Attorney, Agent, or Firm* — Husch Blackwell LLP

(57) ABSTRACT

A product merchandising unit having a plurality of shelf members adjustably positionable within a framework structure, each shelf member including a plurality of retractable pin members selectively movable for engagement with openings associated with the framework structure, and a plurality of removably attachable divider members engageable with the underneath portion of each shelf member anywhere along substantially their entire width, the divider members extending downwardly from the shelf member located thereabove into the product display space of the shelf member located therebelow forming product channels for guiding products therebetween, each divider member being selectively adjustable relative to another divider member to control and adjust the width of each product channel.

36 Claims, 13 Drawing Sheets

U.S. PATENT DOCUMENTS

| | | | | |
|---|---|---|---|---|
| 5,607,068 | A | 3/1997 | Coretti, Jr. et al. | |
| 5,797,502 | A * | 8/1998 | Brady et al. | 211/183 |
| 6,026,752 | A * | 2/2000 | Zachrai | 108/40 |
| 6,273,276 | B1 | 8/2001 | Upton | |
| 6,460,710 | B1 | 10/2002 | Dardashti | |
| 6,474,484 | B1 | 11/2002 | Miller, Jr. | |
| 6,584,916 | B1 * | 7/2003 | Felton et al. | 108/107 |
| 6,729,484 | B2 * | 5/2004 | Sparkowski | 211/187 |
| 6,871,747 | B2 * | 3/2005 | Bustos | 211/50 |
| 6,976,598 | B2 | 12/2005 | Engel | |
| 7,762,410 | B2 * | 7/2010 | Colin et al. | 211/187 |
| 2004/0217073 | A1 * | 11/2004 | Dobler et al. | 211/26 |
| 2004/0256341 | A1 * | 12/2004 | Donnell et al. | 211/187 |
| 2005/0103733 | A1 * | 5/2005 | Saltzberg et al. | 211/187 |
| 2005/0274680 | A1 * | 12/2005 | Allen et al. | 211/26 |
| 2006/0032830 | A1 | 2/2006 | Engel | |
| 2006/0076304 | A1 * | 4/2006 | Kainuma et al. | 211/90.01 |
| 2006/0113262 | A1 | 6/2006 | Knorring, Jr. et al. | |
| 2008/0121600 | A1 * | 5/2008 | Korte et al. | 211/187 |
| 2010/0307998 | A1 * | 12/2010 | Chen | 211/184 |

* cited by examiner

PRODUCT MERCHANDISING SYSTEM FOR WALK-IN DISPLAY COOLERS AND THE LIKE

CROSS-REFERENCE TO RELATED APPLICATION

This application is a non-provisional application claiming the benefit of provisional Patent Application Ser. No. 60/984,037 filed Oct. 31, 2007 the entire disclosure of which is incorporated herein by reference.

The present invention relates generally to product merchandising display racks and, more particularly, to a product merchandising system for use in walk-in type display coolers and the like wherein the divider members associated with each particular shelf member can be selectively positioned and adjusted to accommodate differently sized products, and wherein each individual shelf member is capable of quick and easy vertical and horizontal adjustment relative to its associated frame structure for both flat shelf and gravity feed operations.

BACKGROUND OF INVENTION

Walk-in product merchandising display coolers are commonly used in retail outlets such as convenient stores and grocery stores to display a wide variety of different types of products to consumers. A walk-in cooler typically includes one or more consumer access doors that open into the store area to allow a consumer access to products from display racks and associated shelving positioned adjacent the access doors. Such walk-in display coolers also typically include a storage area located behind the display racks which permits both the storage of product to be ultimately placed on the display racks and provides room for employees to fill the display racks from the rear with products stored within the storage area of the cooler.

A wide variety of different types of shelving systems are typically used for holding and displaying the varied products to consumers from within such coolers. Some of these display systems are movable and some are anchored to the walk-in cooler floor. Some of these units provide a plurality of shelves which are vertically adjustable and positionable within a fixed framework which typically includes four upright support members each including some type of mechanism for vertically adjusting the shelving units positioned therebetween. In some cases, a wire rack is positionable within the upright frame structure associated with each cooler door and additional shelving is positioned on top of this wire rack. Also, importantly, the shelf dividers associated with these systems are typically not adjustable to accommodate differently sized products. Although some of the known shelving systems allow for the initial placement of the shelves within its associated framework structure, once this initial positioning is accomplished, such systems do not allow for easy further adjustability of such individual shelves into other orientations including into other gravity feed orientations or into a horizontal orientation. Still further, such additional repositioning of the individual shelf members typically requires all product from such shelves and, often times, adjacent shelves, to be removed so that the individual shelf member can be repositioned within the associated framework structure. This takes considerable time and typically cannot be accomplished by a single person.

Thus, there is a need for an improved product merchandising system for use in walk-in type coolers and the like wherein the individual shelf members can be easily repositioned both horizontally and vertically within the associated framework structure while the shelf members are loaded to achieve a plurality of different adjustably positionable orientations including a horizontal orientation as well as a plurality of different angular gravity feed orientations; wherein the individual shelf divider members are infinitesimally adjustable to accommodate any width product; wherein the merchandising system is a free-standing unit which can easily replace existing units, either individual or as a single set up across a plurality of cooler doors; and wherein the merchandising system can be a mobile unit which may be used as part of a shuttle system for quick change out of preferred products as a function of the time of day, or simply to replace sold out product.

Accordingly, the present invention is directed to overcoming one or more of the problems as set forth above.

SUMMARY OF INVENTION

The present invention relates to a product merchandising system for use in walk-in display coolers and the like, or other product merchandising areas, wherein the present system includes a framework structure adaptable for adjustably positioning a plurality of individual shelf members therebetween, the framework structure being either non-movable or positioned on a plurality of casters or other wheel means for freely moving the entire system into and/or out of the storage area associated with a cooler space, or from a first location to a second location, when desired for loading and for presenting products to consumers through the cooler door openings. If the framework structure is non-movable, the present product merchandising system can be easily retro-fitted into existing cooler space by replacing existing individual units positioned in front of separate cooler doors with individual respective present systems, or by replacing the entire existing shelving system with the present systems across all of the cooler doors. If individually used, an old unit can be pulled out of the cooler space and a present unit can be moved into that space. If the entire system is replaced, intermediate units of the present system can share common uprights as will be hereinafter explained. When equipped with casters or other wheel means, a plurality of the present product merchandising systems could be used as part of a shuttle system for quickly changing out products within the cooler space wherein one complete system could be fully loaded and held in abeyance until the unit positioned adjacent a particular cooler door is emptied or partially emptied. Change out is easily accomplished by rolling the emptied or partially emptied unit away from the cooler door opening and thereafter immediately positioning the previously restocked unit adjacent that particular cooler door for immediate access by customers.

The present framework structure includes a plurality of upright support members each including a plurality of openings or slots strategically positioned for cooperatively engaging retractable pin members associated with each individual shelf member for vertically adjustably positioning each individual shelf member within the associated framework structure. The openings and slots associated with the vertical upright members are spaced closer than currently available in the marketplace thereby enabling the individual shelf members to be vertically spaced closer together depending upon the size of products positioned thereon and potentially allowing for additional rows of products to be faced towards the cooler door as well as potentially allowing for more individual shelf members to be vertically positioned within the associated framework structure.

In this regard, each individual shelf member includes a plurality of spring loaded retractable pin members associated with each side portion thereof, the pin members being insertably positionable within any one of the plurality of openings or slots associated with the upright support members forming the framework structure. The pin members have sufficient travel between their retracted and extended positions such that they will always hold that particular shelf member at a particular intermediate location within the framework structure regardless of the spacing or tolerance differences between two opposed upright members. Each pin member is spring loaded and attached to a cable system easily accessible by a single person from the underneath portion of each individual shelf member. When the cable system is activated, each respective pin member associated with that particular cable is pulled inwardly so as to release such pin member from its corresponding opening/slot associated with the upright support members. This allows a user to disengage a particular shelf member from the framework structure for repositioning therein. Although several embodiments of a cable system are disclosed and explained hereinafter, it is recognized and anticipated that any release mechanism can be utilized to retract and extend the associated pin members for disengagement and engagement with the associated upright support members. In one embodiment of the present invention, a pair of cable systems are associated with each individual shelf member, one associated with the front portion of the shelf member and one associated with the rear portion of the shelf member. This allows a user to reposition the front portion of the shelf member separate and apart from repositioning the rear portion of the unit. Other systems and configurations are disclosed herein and still other systems and configurations can likewise be used.

The present system also includes a plurality of shelf divider members which are each individually horizontally adjustable across the entire width of each shelf member for changing the width of each product channel to accommodate different sized products. Each of the shelf divider members are removably engageable with the underneath portion of the shelf member positioned thereabove and the divider members will extend downwardly from the shelf member located above into the product display space of the shelf member located therebelow. The underneath side portion of each respective shelf member includes a pair of transverse bar engaging members specifically constructed to receive engagement means associated with the top portion of each respective shelf divider member. Each individual shelf divider member is designed such that a user, standing at the rear of the shelf, can easily position and engage the shelf divider member with the respective transverse bar engaging members associated with the shelf member positioned thereabove. Several embodiments of engagement means for removably attaching and removing each respective shelf divider member along the length of the transverse bar engaging members are disclosed hereinafter. Such mechanisms allow each respective shelf divider member to be positioned and located anywhere along the full length of the width of each shelf member. Any plurality of shelf divider members can be positioned and locked into place along the width of any particular shelf member so as to provide differently spaced product channels with respect to the shelf member positioned therebelow. Also, since the shelf divider members are removably attached to the underneath side portion of the shelf member positioned thereabove, the design and shape of the shelf divider members provides increased stability for taller products while, at the same time, enabling the actual floor surface of each respective shelf member to be a single continuous floor uninterrupted or uninhibited with any type of divider walls or other protrusions or projections which would interfere with product positioning, location, and slidability during gravity feed operations.

The present system may likewise include a drip pan or catch pan at the bottom of the framework structure underneath the lowermost shelf to catch spillage and any glass breakage. This will allow for easy clean up of the overall unit and eliminate spillage onto the floor of the cooler itself.

The present system may likewise include a work tray which can be easily attached to the rear of a particular shelf member for allowing a stock person the ability to place product in easy reach for reloading the individual shelf members.

Other features include an adjustable front spacer member attachable to the framework structure for adjusting the spacing between the framework structure and the cooler door openings; a front product stop or wall member removably attachable to the front of each shelf member so that front walls of different heights can be interchangeable at the store depending upon the type of products being merchandised from each particular shelf member; and a price channel incorporated into or attachable to the front of the product stop member.

It is also anticipated that the overall framework structure associated with the present system can likewise be free standing without any casters or other mobility. In this particular application, the present framework structure can be fixedly attached or otherwise secured or positioned with respect to the cooler floor or other product merchandising area.

These and other features and advantages of the present invention will be apparent to those skilled in the art after considering the following detailed specification in conjunction with the accompanying drawings.

BRIEF DESCRIPTION OF DRAWINGS

For a better understanding of the present invention, reference may be made to the accompanying drawings in which.

DETAILED DESCRIPTION

Figure 1:
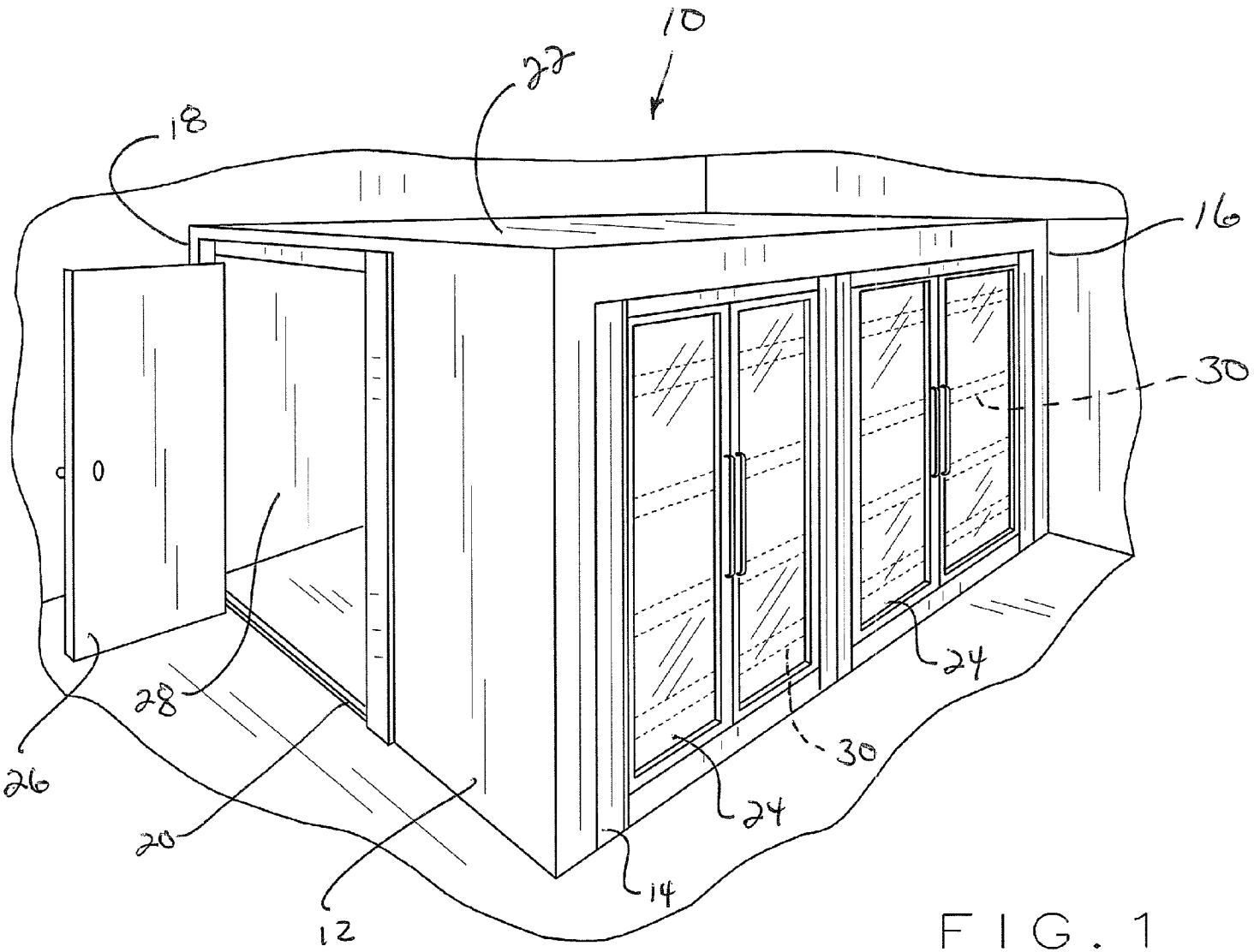
FIG. 1 is a perspective view of a typical walk-in display cooler capable of utilizing the present product merchandising system.

Although the present product merchandising system will be described with respect to use in a typical walk-in display cooler environment, its use is not so limited and it is recognized and anticipated that the present unit and system will be utilized in a wide variety of different applications as will be hereinafter evident. Referring to the drawings more particularly by reference numbers wherein like numerals refer to like parts, the number 30 in FIGS. 1 and 2 identifies one embodiment of a product merchandising system constructed according to the teachings of the present invention. A typical walk-in cooler 10, as illustrated in FIG. 1, includes side walls 12, 14, 16 and 18, a floor 20, and a roof 22. The cooler 10 further includes a plurality of the present product merchandising systems 30 positioned at the front of the cooler adjacent to one or more customer access doors 24 associated with the front cooler wall 14. The cooler 10 is also provided with an access door 26 for ingress and egress of a worker into and out of the interior space 28 for both storing products within the cooler and for stocking and re-stocking the present display systems 30. The above-described cooler 10 is of a type well-known in the art and can be found in a wide variety of retail outlets such as supermarkets, convenient stores, gas stations, grocery stores, and the like. Other embodiments and variations of cooler 10 are also well known and available in the marketplace.

Figure 2:
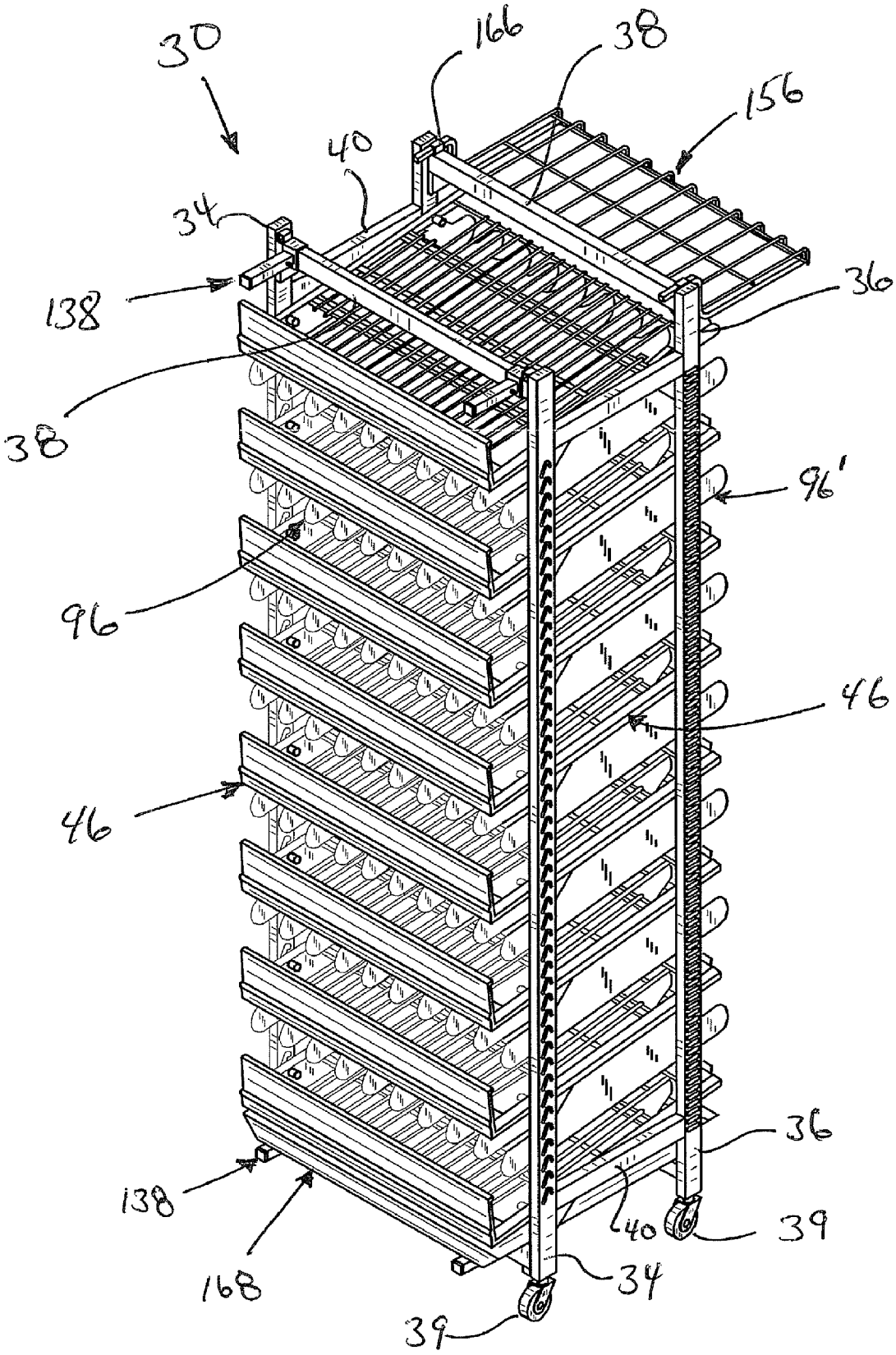
FIG. 2 is a perspective view of one embodiment of the present product merchandising system constructed and assembled in accordance with the teachings of the present invention.
Figure 3:
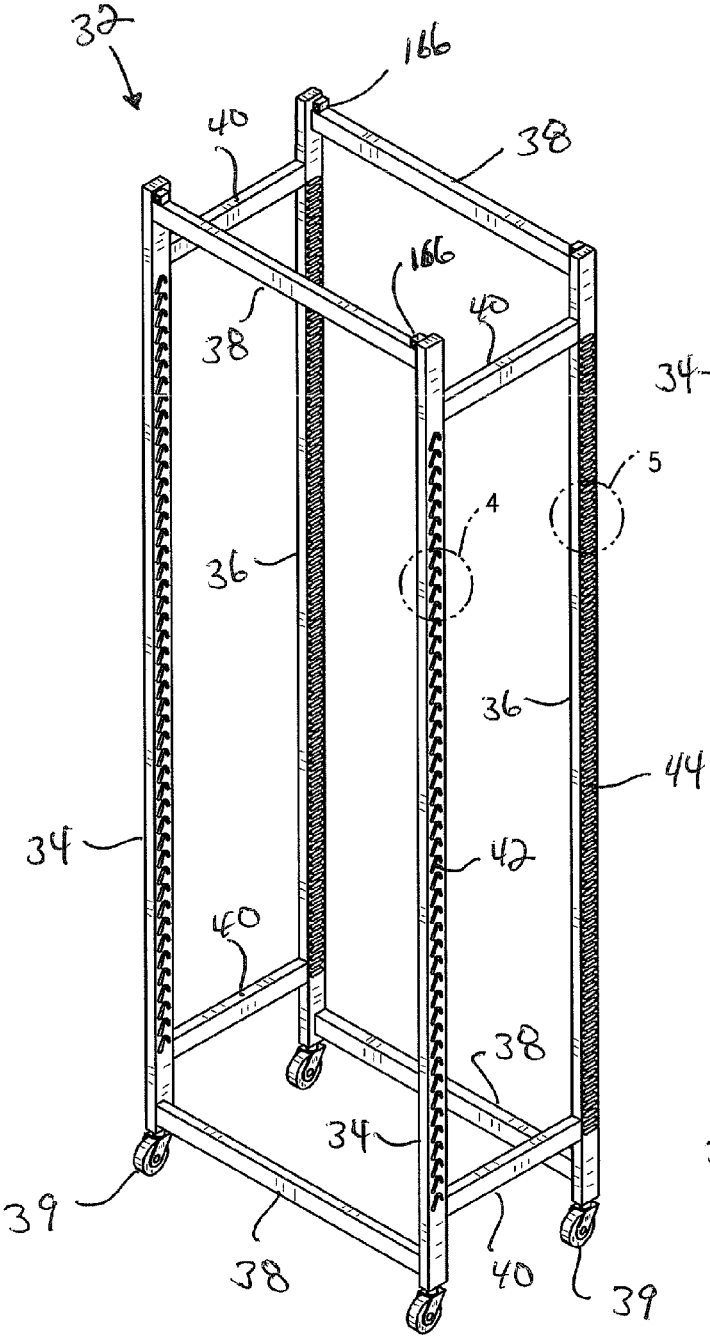
FIG. 3 is a perspective view of the framework structure associated with the product merchandising system of FIG. 2.

As illustrated in FIG. 1, each of the present product merchandising systems 30 is positioned adjacent a corresponding cooler access door 24 and each product merchandising system 30 includes a framework structure 32 having four upright support members 34 and 36 connected together at their respective top and bottom portions via opposed pairs of horizontally extending cross-brace members 38 and 40 as best illustrated in FIGS. 2 and 3. Opposed cross-brace members 38 are associated with the front and rear portions of framework structure 32 and opposed cross-brace members 40 are associated with the side portions of framework structure 32. The framework structure 32 can be integrally formed as a one-piece unit, or cross-brace members 38 and 40 may include connecting means associated with each opposite end portion thereof for cooperatively engaging corresponding means associated with the respective upright support members 34 and 36. These cooperatively engageable means may include any well known means for accomplishing this task including one or more projections associated with the respective opposite end portions of the cross-brace members 38 and 40 which cooperatively engage corresponding openings or slots associated with the respective upright support members 34 and 36; a projection/keyhole slot arrangement; or other suitable engaging means. In this regard, if the upright support members and corresponding cross-brace members are to be removably engageable with each other, such mechanism must provide for a strong, stable joinder between the various members while at the same time being easily assembled by a single person. In the particular embodiment illustrated in FIGS. 2 and 3, upright support members 34 represent the front support members while upright support members 36 represent the rear support members. Each upright support member 34 and 36 may likewise include a caster or other wheel means 39 for allowing the entire system 30 to be freely selectively movable from a first location to a second location.

Figure 4:
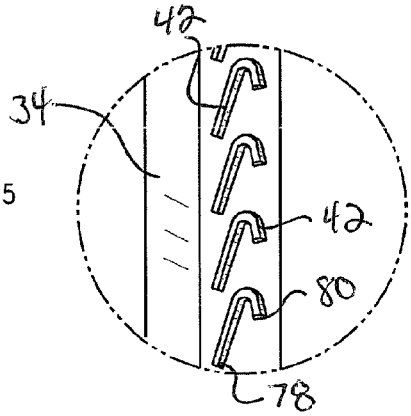
FIG. 4 is an enlarged fragmentary perspective view of the openings associated with the front upright support members of the framework structure of FIG. 3.
Figure 6:
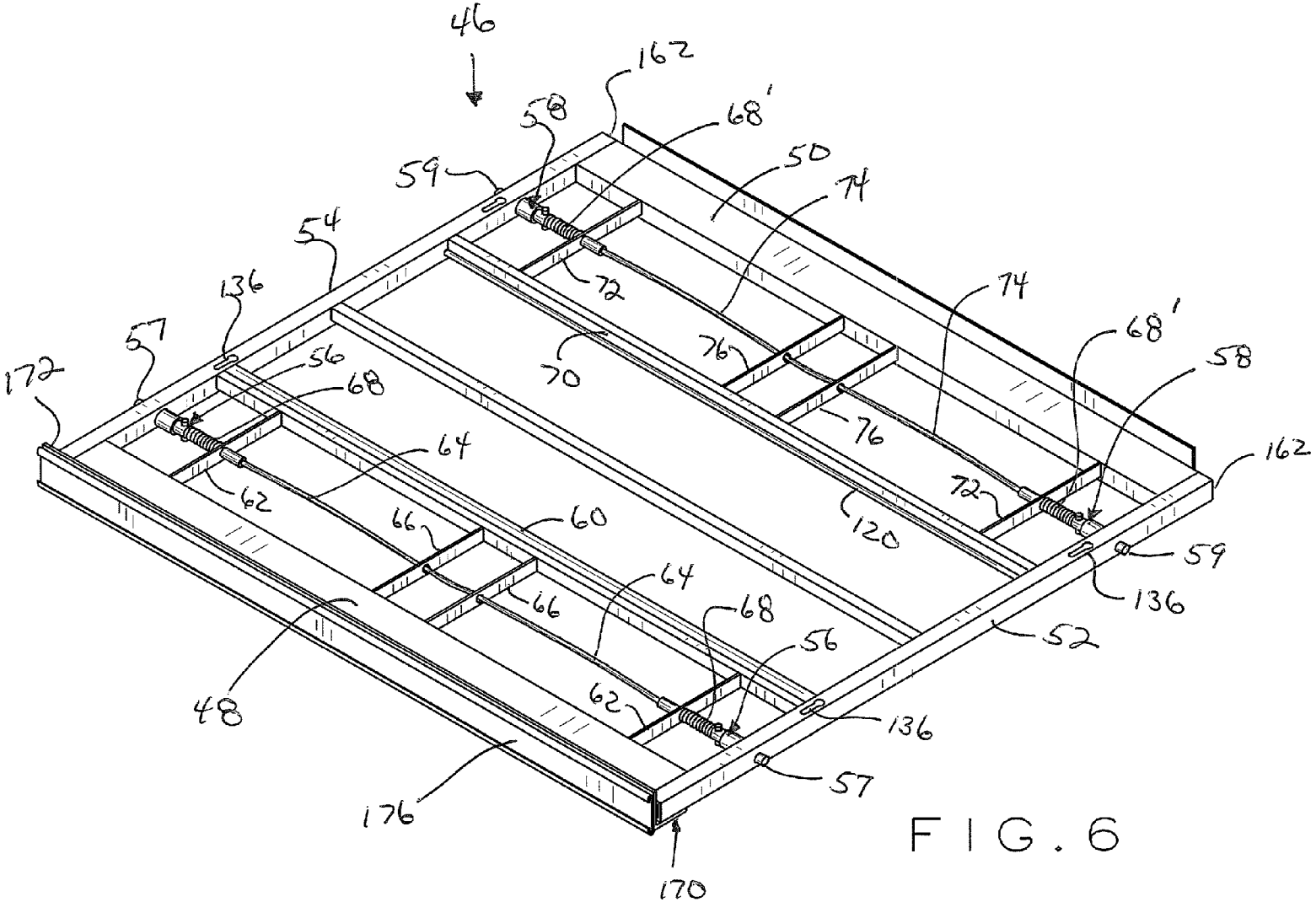
FIG. 6 is a perspective view of one embodiment of a shelf member constructed in accordance with the teachings of the present invention for use with the product merchandising system of FIG. 2.
Figure 7:
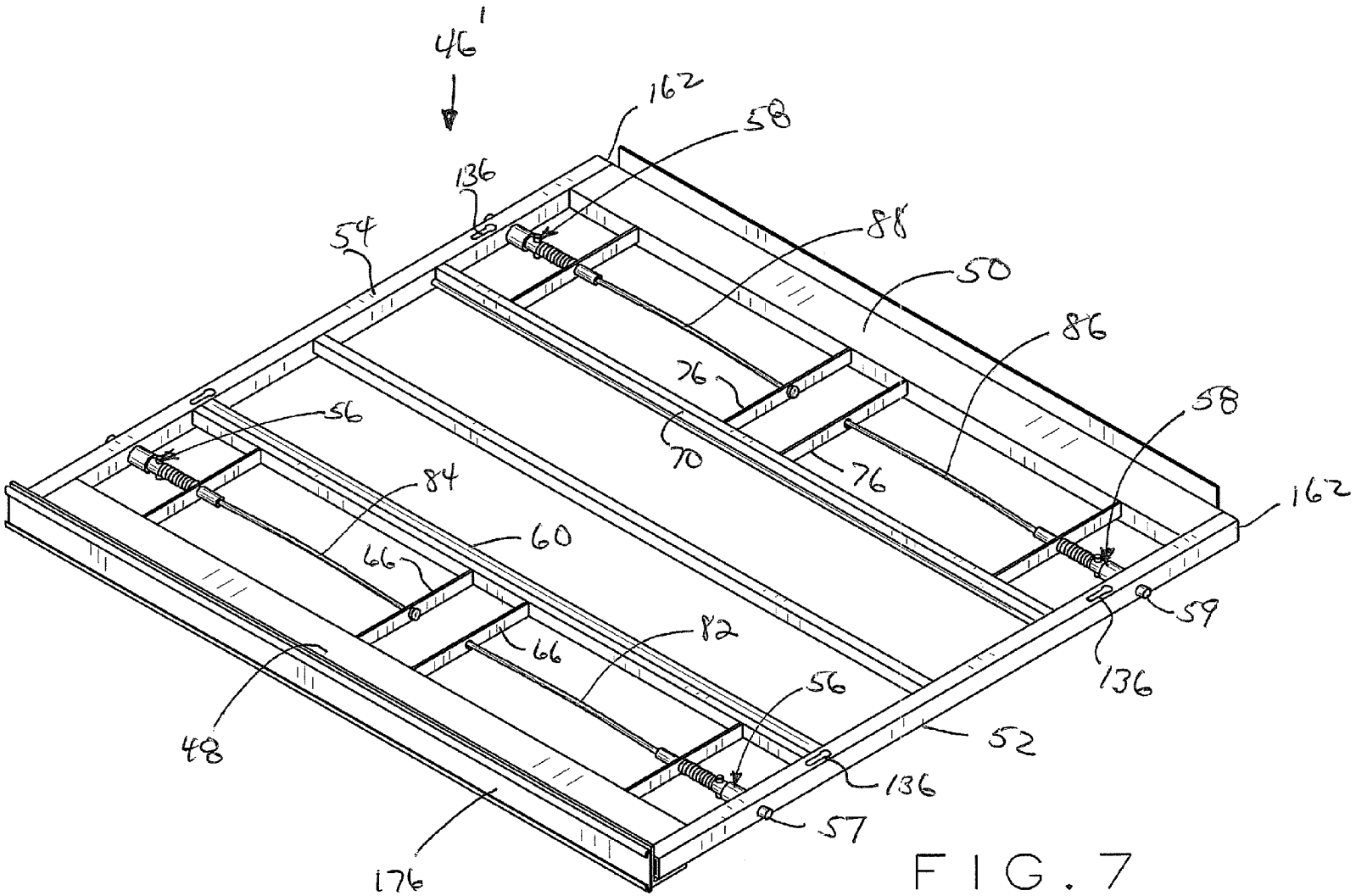
FIG. 7 is a perspective view of another embodiment of a shelf member similar to the shelf member of FIG. 6 except utilizing a different cable arrangement.
Figure 8:
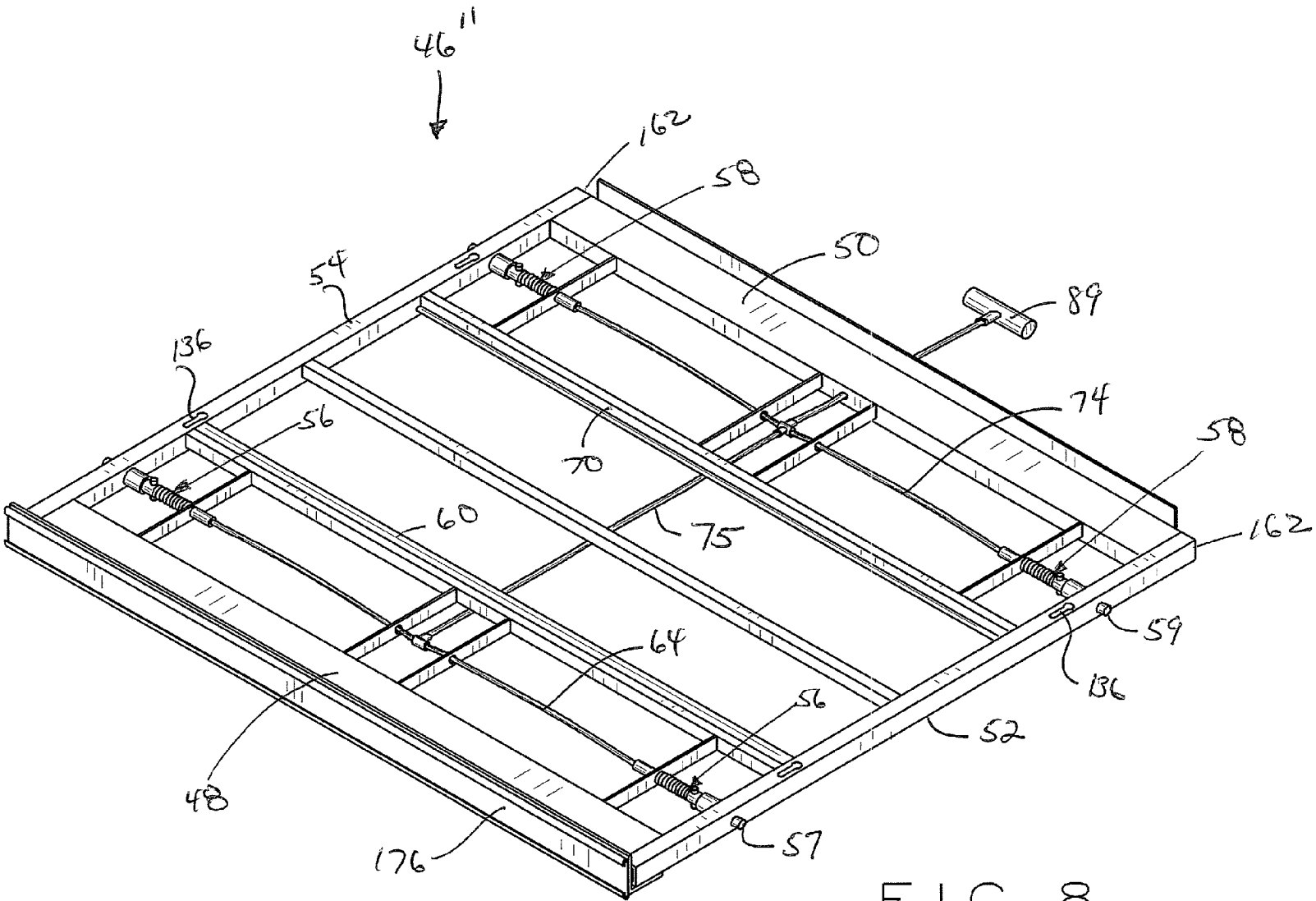
FIG. 8 is a perspective view of still another embodiment of a shelf member utilizing still another cable arrangement.

When the framework structure 32 is positioned adjacent a respective cooler access door 24, the front upright support members such as the support members 34 include a plurality of openings 42 positioned in spaced apart relationship along a substantial portion of two opposed side walls forming the front upright support members 34 as illustrated in FIGS. 3 and 4. The openings 42 are in the shape of a candy cane as best illustrated in FIG. 4 and the vertical incremental spacing between each respective opening 42 is much closer than currently available thereby enabling the individual shelf members 46 to be vertically spaced closer together depending upon the size of the products to be positioned on each respective shelf member and potentially allowing for additional rows of products to be faced towards the cooler door 24 for merchandising such products to consumers. Each individual shelf member 46 will include a pair of retractable pin members 57 associated with each front side portion thereof as best illustrated in FIGS. 6-8, the respective pin members 57 being insertably positioned within any one of the plurality of openings 42 associated with the front upright support members 34 for holding the front portion of that particular shelf member at a particular intermediate location within the framework structure 32 as will be hereinafter further explained. Since the openings 42 extend through or are located on both opposed side walls of the front support members 34, the upright members 34 are interchangeable and can be used on either side of the framework structure 32.

Figure 5:
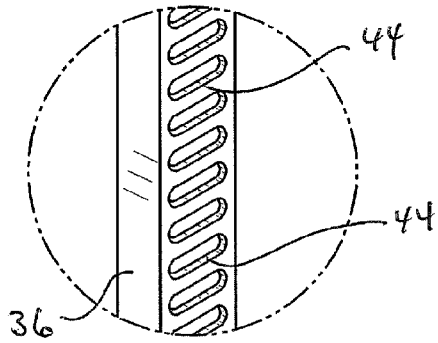
FIG. 5 is an enlarged fragmentary perspective view of the slots associated with the rear upright support members of the framework structure of FIG. 3.

In similar fashion, the rear upright support members 36 each include a plurality of slots 44 positioned in spaced apart relationship along a substantial portion of two opposed side portions of the rear support members 36 as best illustrated in FIGS. 3 and 5. Here again, the incremental vertical spacing between the respective slots 44 is much closer together than currently available thereby likewise enabling the individual shelf members 46 to be vertically spaced closer together depending upon the size of the products positioned thereon. Each individual shelf member likewise includes a pair of retractable pin members 59 associated with each rear side portion thereof as best illustrated in FIGS. 6-8, the rear pin members 59 being insertably positioned within any one of the plurality of slots 44 associated with the rear upright support members 36 for holding the rear portion of that particular shelf member at a particular intermediate location within the framework structure 32.

FIG. 6 illustrates one embodiment of the plurality of individual shelf members 46 utilized within the framework structure 32. Each shelf member 46 is substantially rectangular in shape and includes front and rear transverse frame members 48 and 50 and opposed side frame members 52 and 54. A pair of retractable pin member assemblies 56 are mounted adjacent the front portion of the shelf member 46 and a pair of retractable pin member assemblies 58 are mounted adjacent the rear portion of the shelf member 46 as best illustrated in FIG. 6. The pin member assemblies 56 are mounted to the front portion of the shelf member 46 between front frame member 48 and a transverse member 60 and each assembly includes a spring plunger having a pin member 57 associated with one end portion that is biased outwardly towards its extended position by a spring member 68. The assemblies 56 extend through and are supported by a guide/bracing member 62 which is positioned and located between members 48 and 60 as best illustrated in FIG. 6. Each guide/bracing member 62 includes an opening allowing one end portion of the retractable pin assembly 56 to extend therethrough for attachment to a conventional cable member 64, the cable member 64 having its opposite end portions attachable to the opposite end portion of each of the front retractable pin member assemblies 56 as illustrated in FIG. 6. Cable member 64 likewise extends through a pair of additional guide/bracing members 66 as illustrated to provide additional support to the cable member 64. The terminal end portion of each retractable spring plunger, namely, the pin member 57, extends through an opening in the respective opposed side frame members 52 and 54 as illustrated. The spring member 68 biases the pin member 57 to its extended position as illustrated.

When the cable member 64 is pulled in a direction towards the front or rear of the shelf member 46, the respective pin members 57 are retracted against the compression of spring member 68 to a position within the side perimeter of the shelf member 46. When the cable member 64 is released, each spring member 68 biases its respective pin member 57 outwardly through the opening associated with each respective side frame member 52 and 54 such that the pin members 57 extend beyond the side perimeter of the shelf member 46 for engagement with the openings 42 associated with the front upright support members 34 as will be hereinafter explained. The shelf member 46 is designed so that it can be easily grasped by a user and securely held in hand before cable member 64 is activated and before the pin members 57 are released.

The retractable pin member assemblies 58 associated with the rear portion of shelf member 46 are substantially identical in construction to the pin member assemblies 56 and are positioned and located between rear frame member 50 and transverse member 70 as again illustrated in FIG. 6. Each assembly 58 includes a spring plunger having a pin member 59 associated therewith extending through an opening in the respective opposed side frame members 52 and 54 as illustrated, the pin member 59 being biased towards its extended position by spring member 68' in the same fashion as previously explained with respect to retractable pin assemblies 56. Like assemblies 56, the assemblies 58 extend through and are supported by guide/bracing members 72. The bracing members 72 are positioned and located between the members 50 and 70 as previously explained with respect to bracing members 62. An additional cable member 74 is attached to the opposite end portions of each of the rear pin member assemblies 58 as illustrated in FIG. 6 and extend through openings associated with additional guide/bracing members 76 for the same reasons as explained above. When cable member 74 is pulled in a forward or rearward direction, the pin members 59 are retracted against the compression of spring members 68' within the side perimeter of shelf member 46 similar to pin members 57. When the cable member 74 is released, pin members 59 are again biased outwardly through spring members 68' so as to extend beyond the respective side frame members 52 and 54 for attachment to the slots 44 associated with the rear upright support members 36. Here again, the shelf member 46 can be easily and securely grasped by a user before cable member 74 is activated and before pin members 59 are released.

Each individual shelf member 46 can be easily manipulated and maneuvered for engagement with the framework structure 32. Shelf member 46 is positioned at the appropriate location within the framework structure 32 and a user merely pulls the respective cable members 64 and 74, either in a forward or a rearward direction, so as to retract the respective pin members 57 and 59 within the perimeter of the side frame members 52 and 54. With the pin members 57 and 59 retracted, the shelf member is positioned adjacent the upright support members 34 and 36 and the respective cable members 64 and 74 are released. When the front cable member 64 is released, pin members 57 are urged outwardly and extend beyond the perimeter of side frame members 52 and 54 so as to engage one of the plurality of openings 42 associated with the front upright support members 34. In similar fashion, when the rear cable member 74 is released, pin members 59 are urged outwardly and extend beyond the perimeter of side frame members 52 and 54 so as to engage one of the plurality of slots 44 associated with the rear upright support members 36. In this regard, the rear pin members 59 can be selectively positioned in any one of a plurality of slots 44 so as to provide a substantially flat horizontal presentation of the shelf member 46 to consumers through the cooler door 24, or so as to achieve any particular angular orientation for a gravity feed operation. Angular orientations in the range of about ±12° are easily achieved by the present arrangement of the openings 42 and slots 44, and other orientations are likewise possible.

It is important to note that the respective pin members 57 and 59 have sufficient travel distance between their respective retracted positions and extended positions such that pin members 57 and 59 will always engage the respective openings 42 and slots 44 regardless of any spacing or tolerance differences between the respective pairs of opposed upright support members 34 and 36 associated with different product merchandising units 30 when a particular shelf members 46 is manipulated and maneuvered for engagement with the framework structure 32. Due to manufacturing tolerances and differences in the width or spacing between the opposed front and rear upright support members 34 and 36, the travel of the respective pin members 57 and 59 is such that regardless of such spacing differences between respective product merchandising units 30, each respective shelf member 46 will fully engage the respective openings and slots 42 and 44. In this regard, each pin member 57 and 59 may be slightly tapered and may include a shoulder portion (not shown) such that the shoulder portion will always rest against or abut the surface of the respective upright support member adjacent the respective opening 42 or slot 44 into which such pin member will extend. This travel of the pin members therefore ensures that the pin members are always engaged with the respective openings and slots 42 and 44 regardless of any spacing differences due to manufacturing tolerances.

Still further, it is important to note that the candy cane shaped openings 42 provide for two different locations 78 and 80 for securing the front pin members 57 within a respective opening 42. Because of the shape of the openings 42, the pin members 57 can be positioned and secured within the slot cavity 78 formed at one end portion of the opening 42, or it can be positioned in slot cavity 80 formed at the opposite end portion of the opening 42. Slot cavity 78 is positioned and located towards the front portion of the front upright support members 34 and therefore allows the overall shelf member 46 to be located closer to the cooler door 24 or other structure. In contrast, slot cavity 80 is located towards the rear portion of the front upright support members 34 and allows the front wall portion of the shelf member 46 to be positioned farther away from the cooler door 24 or other structure as compared to slot cavity 78. This enables a user to selectively adjust the spacing of the front portion of each shelf member 46 relative to the cooler door 24 or other structure based upon the types of products being merchandised from each individual shelf. This allows a user to better control the shelf set back distance from the cooler door or other structure within the same opening 42. Because of the candy cane shape of the openings 42, the pin members 57 will be securely held in either slot cavity 78 or slot cavity 80 once positioned therein. This small adjustment with respect to each individual opening 42 provides great flexibility and adjustability to a user when orienting products within the units 30. Also, the shape of the openings 42 also increases the likelihood that the pin members 57 will always find, hit or extend into the respective openings 42 during installation or re-positioning of the shelf members 46.

It is recognized that initial installation of any particular shelf member 46 onto a substantially empty framework structure 32 may require the use of two individuals, one at the front of the unit and one at the back of the unit, to initially position such shelf member. Once the shelf members 46 are initially positioned within the framework structure 32, additional adjustments and reconfiguration of any particular shelf member 46 can be easily and quickly accomplished by a single individual. For example, an individual standing at the rear of the overall system 30 can pull the rear cable member 74 so as to retract pin members 59 thereby freeing the rear portion of any particular shelf member 46 for movement up or down for engagement with another pair of slots 44 associated with the rear upright support members 36. In similar fashion, the front of any particular shelf member 46 can likewise be easily and quickly adjusted by a single person standing at the front of the system 30 by pulling the cable member 64 to retract pin members 57 and thereafter reengaging such pin members with another pair of openings 42 including moving the pin members 57 to the unused slot cavity 78 or 80 associated with the same opening 42. This readjustment can be easily accomplished with a fully loaded shelf member 46.

Still further, it is also recognized and anticipated that other cable configurations can likewise be utilized with each respective shelf member 46 to retract and extend the pin members 57 and 59. For example, as best shown in FIG. 7, each individual pin member assembly 56 and 58 may include its own separate cable member, such as cable members 82, 84, 86 and 88, each of which must be individually activated in order to retract its associated pin member 57 and 59. In this regard, the structure of shelf member 46' is substantially identical to the structure of shelf member 46 illustrated in FIG. 6 as previously described, including the structure and operation of the pin member assemblies 56 and 58, except that one end portion of each of the respective cable members 82, 84, 86 and 88 is fixedly attached to one of the respective guide/bracing members 66 and 76 as illustrated in FIG. 7. As with cable members 64 and 74, each respective cable member 82, 84, 86 and 88 can be pulled in a forward or rearward direction against the spring loaded pin members 57 and 59 to retract such pin members within the perimeter of side frame members 52 and 54 as previously explained. Obviously, release of any one of the individual cable members 82, 84, 86 and 88 will extend that particular pin member beyond the perimeter of the respective side frame member 52 and 54 for engagement with a respective opening or slot 42 and 44 as previously explained. Again, proper holding and handling of the shelf member 46' is required before any of the cable members 82, 84, 86 and 88 are activated and before the respective pin members 57 and 59 are released.

Still further, it is also recognized and anticipated that the cable members associated with each respective pin member assembly 56 and 58 can be tied together through a cable system having a single activation mechanism such that when the activation mechanism is pulled or otherwise engaged, all of the individual pin members 57 and 59 will be retracted for positioning or repositioning of a shelf member 46 within the framework structure 32. One embodiment of this mechanism is illustrated in FIG. 8 wherein shelf member 46" is substantially identical in structure to shelf member 46 illustrated in FIG. 6 except that cable members 64 and 74 are tied together through cable member 75 in a conventional manner such that pulling cable member 75 will, in turn, pull cable members 64 and 74 as previously explained to release pin members 57 and 59. Cable member 75 may have a pull handle 89 or other activation member such that when the pull handle 89 is pulled or otherwise activated, all of the pin members 57 and 59 will be simultaneously retracted and released from their corresponding openings and slots 42 and 44. In similar fashion, when the pull handle 89 or other activation mechanism is released, all of the pin members will be extended as previously explained and reengaged with one of the openings or slots 42 and 44 associated with the front and rear upright support members 34 and 36. In this particular embodiment, it is preferred that handle member 89 be associated with the rear of the shelf member 46" so as to accomplish all maneuvering of the shelf member from the back side of unit 30. Again, proper holding and handling of the shelf member 46" is required as previously explained before the pin members are released.

Figure 9:
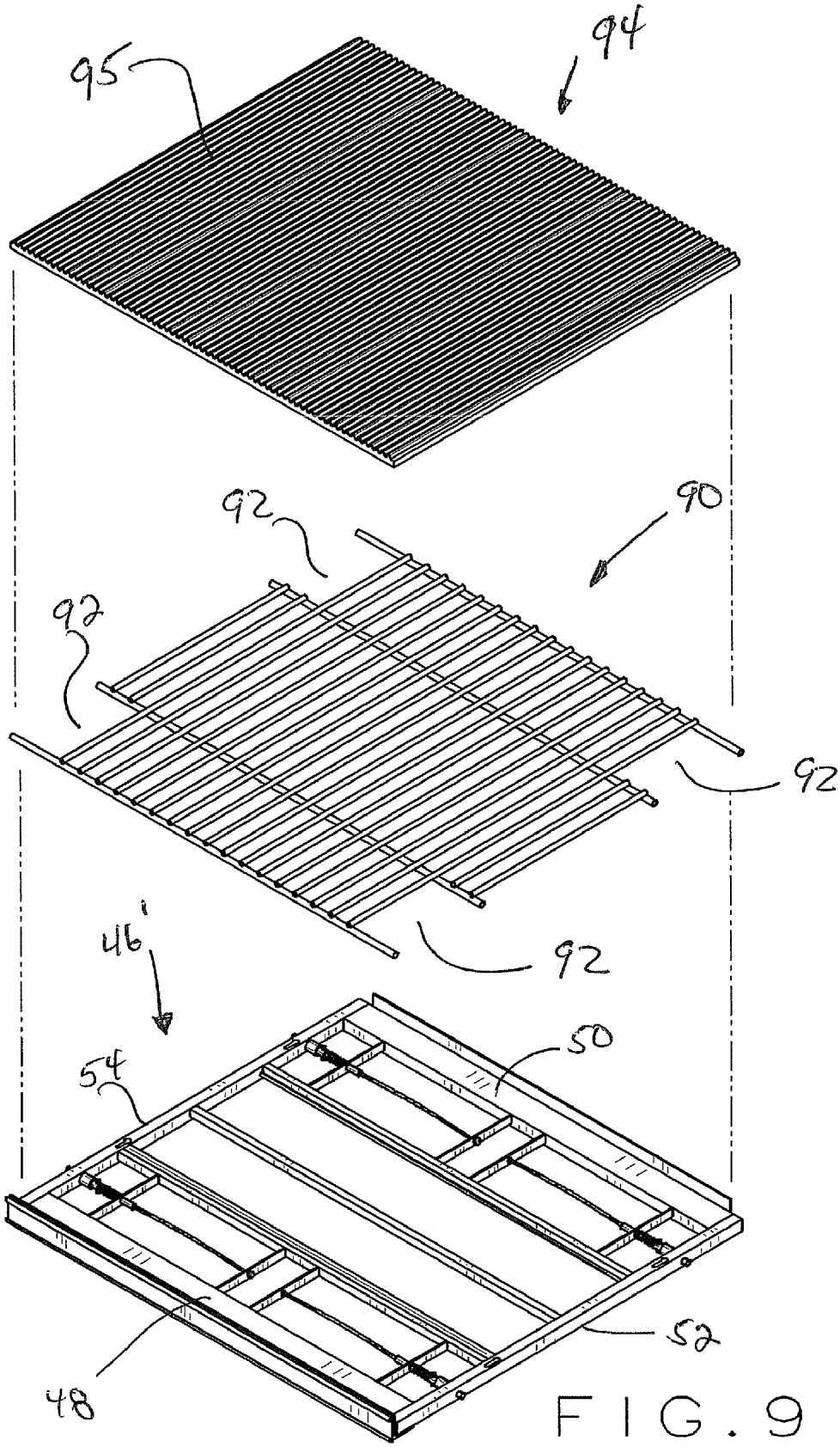
FIG. 9 is an exploded perspective view of one embodiment of the present shelf members showing a wire grid member and a gravity feed floor member constructed in accordance with the teachings of the present invention for use with the present shelf members.

A wire grid structure such as wire grid member 90 illustrated in FIG. 9 is shaped and dimensioned so as to fit within the recessed area formed by and between the shelf member front, rear and side members 48, 50, 52 and 54. The wire grid member 90 is inserted onto the top portion of the shelf member 46' and provides a floor surface for the shelf member. Depending upon the type of products to be merchandised from a particular shelf member 46', the wire grid member 90 may provide a sufficient floor surface for holding and merchandising certain types of products. It should be noted that the wire grid member 90 may include cut out portions 92 located at the respective corners thereof, the cut outs 92 overlaying the spring loaded pin member assemblies 56 and 58 so as not to interfere with the operation of such assemblies. Depending upon how the pin member assemblies 56 and 58 are mounted within a particular shelf member, the cut out portions 92 may not be necessary. If necessary, the wire grid member 90 can be further secured to the shelf member 46' by suitable conventional means.

In addition, and particularly for gravity feed operations, a gravity feed floor member 94 can be positioned on top of the wire grid member 90 and secured thereto in a conventional manner as illustrated in FIG. 9. The floor member 94 includes a substantially flat base portion having a plurality of ribs or runners 95 extending upwardly therefrom for supporting a wide variety of different types of products. The runners 95 may be triangular in shape and are sufficiently spaced so as to adequately support products positioned thereon while at the same time reducing friction between the floor member 94 and the products positioned thereon. The floor member 94 may be of unitary construction and formed from a relatively rigid plastic material which is also preferably mixed or impregnated with a silicone resin or other lubricant to improve the slidability of products positioned thereon. It is also recognized and anticipated that the floor member 94 may be made from other materials including metallic and non-metallic sheet members. When positioned on top of grid member 90, the floor member 94 provides a smooth continuous surface for both holding and supporting products positioned thereon, and for allowing such products to slide forward in a gravity feed operation. This is particularly important when the present shelf members 46, 46' and/or 46" are positioned in a gravity feed orientation since products positioned thereon must be able to slide under the force of gravity towards the front portion of the shelf member when the forwardmost products are removed therefrom. It is also important that the spacing between the runners 95 associated with the floor member 94 be such as to accommodate and support any and all of the various products that are to be positioned thereon regardless of the shape or contour of their bottom walls. Since many articles of merchandise are packaged in containers having unique and unusual shapes, it is usually preferred to have the spacing between the runners substantially uniform and relatively small across the width of the floor member 94 so as to accommodate and support products having many different bottom wall configurations. The specific spacing selected may be especially important for some products that have contoured bottom wall portions to properly support such products on the runners to reduce the possibility that they will overturn. In this regard, each individual floor member 94 may include any plurality of runners 95 depending upon the spacing between each pair of runners so selected. It is also recognized that the floor member 94 may be substantially flat and may not include any type of runners or ribs depending upon the particular application.

Figure 10:
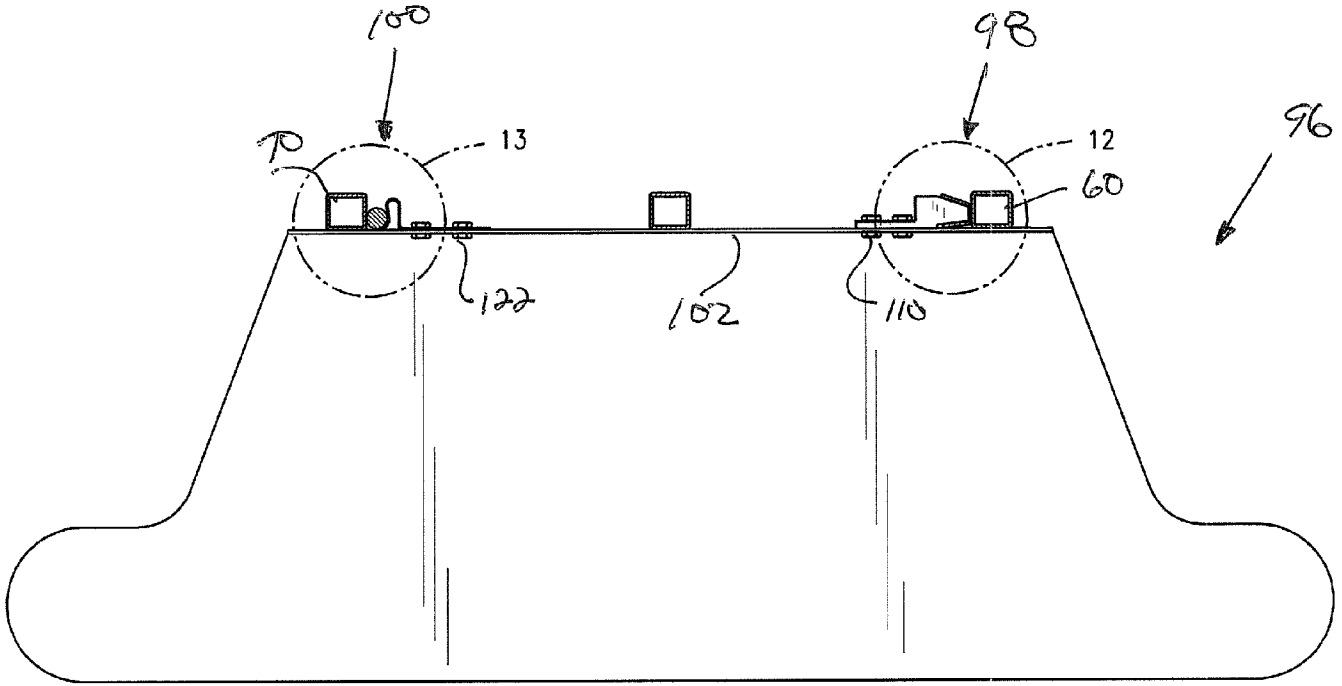
FIG. 10 is a side elevational view of one embodiment of a shelf divider member constructed in accordance with the teachings of the present invention.
Figure 11:
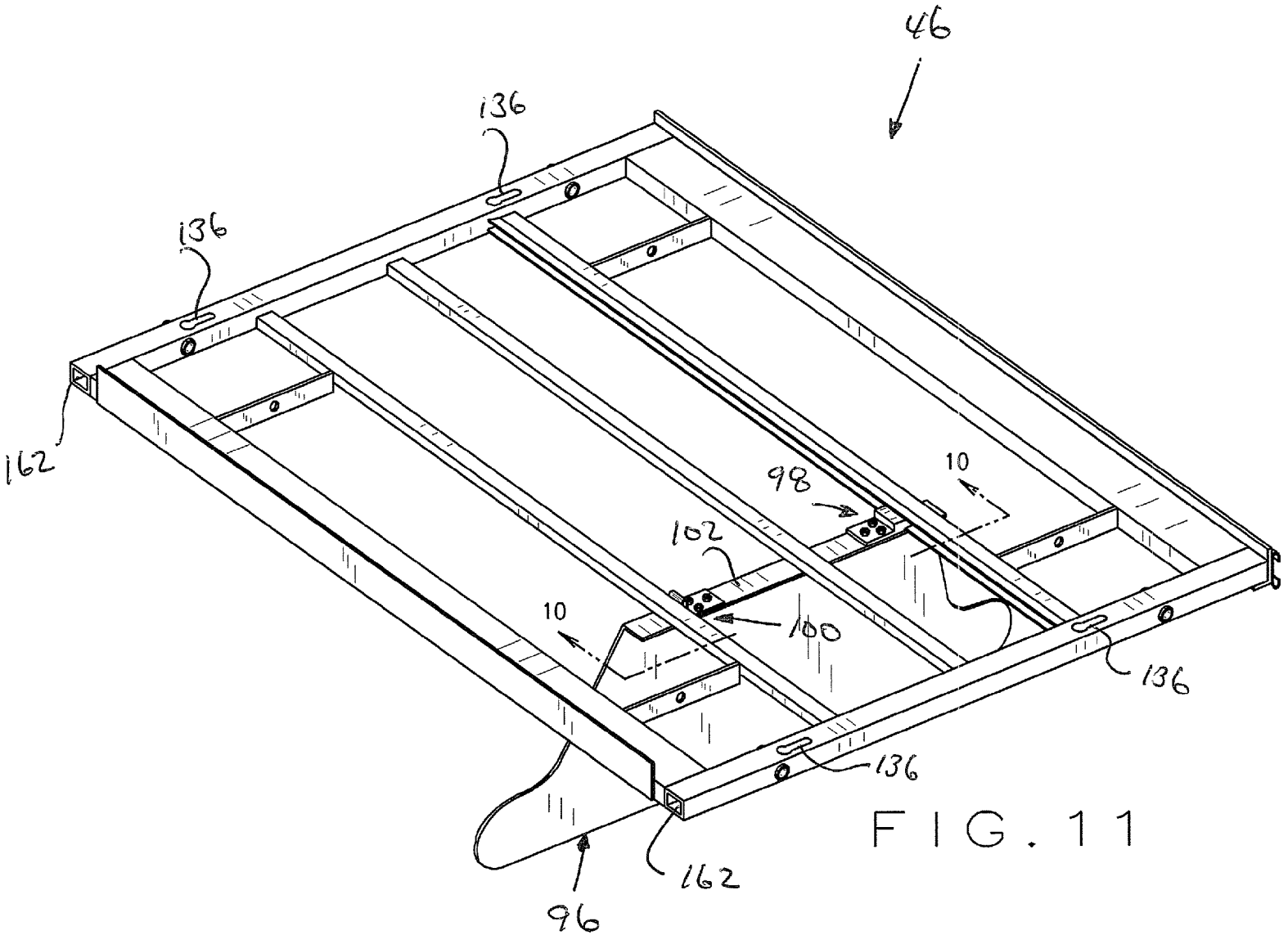
FIG. 11 is a perspective view showing the divider member of FIG. 10 attached to a present shelf member.

The present product merchandising system 30 includes a plurality of shelf dividers 96 as best illustrated in FIGS. 10 and 11 for horizontally adjusting the width of each product channel to accommodate different size products which will be positioned on the respective shelf members 46. As will be hereinafter explained, these horizontal adjustment increments will be substantially infinitesimal thereby allowing a user to easily vary and change the individual product channels associated with any particular shelf member 46. In this regard, except for the outer most shelf dividers 96' as will be hereinafter further explained, each of the shelf dividers 96 are selectively removably engageable with the underneath portion of each respective shelf member 46 positioned thereabove along its entire width and the shelf dividers 96 will extend downward from the shelf member located thereabove into the product display space of the shelf member 46 located therebelow as illustrated in FIGS. 1 and 11. This enables the actual floor surface of each shelf member 46 to be a single continuous floor member uninterrupted or uninhibited with any type of divider walls or other protrusions or projections which would interfere with product positioning and location such as the gravity feed floor member 94. Also, importantly, since the shelf divider members 96 extend downwardly from the shelf member located thereabove, they provide better stability for taller products which have a tendency to tumble or tip over as they progress forward during a gravity feed operation. As best illustrated in FIGS. 10 and 11, the divider members 96 are sized and shaped so as to provide lateral support to the upper portion of products as such products slide to the front portion of each respective shelf member 46. This is especially true when such products are soft drink type containers which come in various shapes and sizes.

Figure 13:
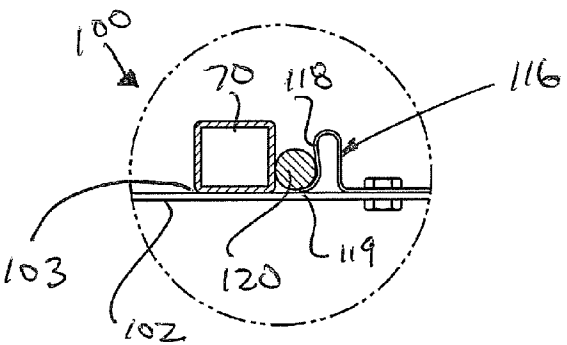
FIG. 13 is a fragmentary side elevational view showing the rear engagement means of the divider member of FIG. 10 engaged with corresponding means associated with the present shelf members.

As best illustrated in FIGS. 11 and 13, the underneath side portion of each respective shelf member 46 includes a pair of transversely extending shelf frame bar engaging members 60 and 70 specifically constructed to receive the engagement means 98 and 100 associated with the top portion 102 of each respective shelf divider member 96. Each individual divider member 96 is designed such that a user, standing at the rear of the system 30 and shelf members 46, can easily position and engage a shelf divider member 96 with the respective front and rear bar engaging members 60 and 70 as will be hereinafter explained.

Figure 12:
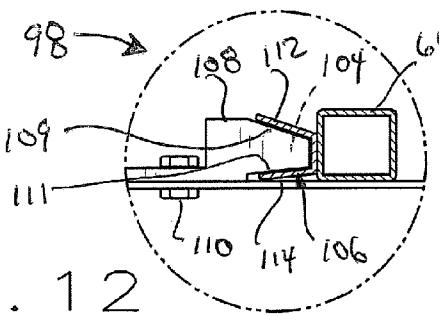
FIG. 12 is a fragmentary side elevational view showing the front engagement means of the divider member of FIG. 10 engaged with corresponding means associated with the present shelf members.

FIGS. 11 and 12 illustrate one mechanism for removably attaching and sliding each respective shelf divider member 96 along the transversely positioned bar engaging members 60 and 70 so as to position and locate each respective shelf divider member 96 anywhere along the full length of the width of each shelf member 46. As best illustrated in FIG. 12, the front bar engaging member 60 associated with the underside portion of each respective shelf member 46 includes a cavity 104 formed by a flange member 106 which is formed with or otherwise attached to the bar member 60. The cavity 104 of flange member 106 is adapted to receive a wedge member 108 which is positioned and located on the top portion 102 of the divider member 96. Wedge member 108, in this embodiment, constitutes engagement means 98 and such wedge member can be attached to the top flange member 102 of divider member 96 by any suitable means such as through the use of rivets or other fastening means 110. Also, it is recognized that the flange member 106 and transverse bar member 60 may be integrally formed as a one-piece unit, or flange member 106 could be fixedly attached to bar member 60 via any suitable joinder means such as by welding.

As clearly shown in FIG. 12, the upper and lower flange leg portions 112 and 114 are angularly oriented so as to correspond to the respective tapers associated with the top and bottom portions 109 and 111 of the wedge member 108. This angular orientation helps to guide the wedge member 108 into the cavity 104 formed by the flange member 106. Since the flange member 106 extends the full width of the transverse bar member 60, the front engagement means 98 (wedge member 108) can be easily and quickly positioned within the flange member 106 at any location along the full length of transverse bar member 60. This allows a user to position any plurality of divider members 96 at any location along the length of bar member 60. The tapers associated with flange leg portions 112 and 114 and the top and bottom portions 109 and 111 of wedge member 108 are such that the wedge member 108 is frictionally held within the flange member 106. This friction fit between wedge member 108 and flange member 106 prevents lateral movement of the divider members 96 along the length of flange member 106 at the front portion of the shelf member thereby preventing "walking" of the front portion of the divider members 96 over time. This solves an age old problem and provides a proper merchandising solution.

As clearly shown in FIG. 13, the rear divider member attachment means 100 is likewise associated with the top flange member 102 of divider member 96 and, in this embodiment, rear attachment means 100 includes a pre-loaded resilient spring-like member 116 which includes an angularly oriented rear portion 118 having a concaved terminal end portion 119 which is shaped and dimensioned so as to engage a wire or rod member 120 associated with the rear shelf bar engaging member 70. The wire member 120 can be welded or otherwise attached to the rear bar engaging member 70 as illustrated, or such member can be integrally formed therewith. Once the wedge member 108 associated with the front portion of the shelf divider member 96 is positioned within the cavity 104 associated with the flange member 106, a user simply rotates the rear portion of that particular shelf divider member 96 in an upward manner so as to allow the angular rear portion 118 of the spring-like member 116 to slide along the wire member 120 until its terminal end portion 119 engages the wire member as illustrated in FIG. 13. This engagement holds the shelf divider member 96 securely in place.

The shelf divider member 96 should have at least two engagement points to keep each divider member 96 in parallel relationship to each other and so as to keep such members from "walking over time." Once the front wedge member 108 is positioned within the flange member 106, the divider member 96 can be moved and further adjusted along the length of the front bar engaging member 60 until it is positioned at the proper location wherein, at that time, the rear engagement means 100 is raised into engagement with the rear bar engaging member 70 as previously explained. This locks and holds that particular shelf divider member 96 in position along the width of any particular shelf member 46. As best illustrated in FIG. 2, any plurality of shelf divider members 96 can be positioned and locked into place so as to provide differently spaced product channels with respect to the shelf member 46 positioned therebelow. Like wedge member 108, the resilient spring-like member 116 can be attached to the top flange member 102 of divider member 96 by any suitable means such as through the use of rivets or other fastening means 122. It is also recognized and anticipated that an optional gasket member (not shown) can be positioned at location 103 (FIG. 13) between the top divider flange member 102 and rear shelf bar engaging member 70 to increase the friction therebetween to prevent "walking" of the rear portion of the divider members 96 over time.

Figure 14:
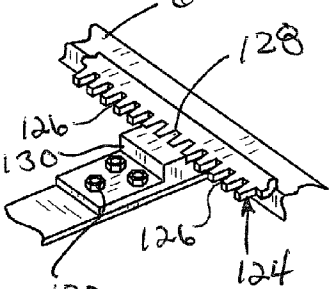
FIG. 14 is a fragmentary perspective view of another embodiment of the front engagement means associated with the present divider member and shelf member.

FIG. 14 illustrates another engagement mechanism for engaging the front portion of a shelf divider member 96 with the front bar engaging member 60. In this particular embodiment, the front bar engaging member 60 includes a flange member 124 having a plurality of spaced openings 126 positioned therealong adapted to receive one or more teeth 128 associated with a wedge member or coupling member 130. Wedge member or coupling member 130, like wedge member 108, is fixedly attached to the top flange member 102 of divider member 96 by any suitable means such as through the use of rivets or other fastening means 132. In this particular embodiment, engagement of the teeth 128 with any of the plurality of openings 126 serves to lock the front portion of the shelf divider member 96 into its proper position. Unlike engagement means 98 illustrated in FIGS. 10 and 12, use of cooperatively engaging members 124 and 130 does not allow a user to first position the coupling member 130 into engagement with the flange member 124 and thereafter move the divider member along the length of the front bar engaging member 60 until it is positioned at its proper location. Instead, a user must strategically select where the divider member is to be positioned along the width of any particular shelf member 46 before coupling member 130 is engaged with flange member 124. However, once the front portion of a particular divider member 96 is properly positioned into engagement with flange member 124, the rear engagement means 100 previously described above can be utilized to again lock and hold the divider member 96 in proper position. In this regard, as previously explained, a user simply rotates the rear portion of the divider member 96 in an upward manner so as to allow the spring-like member 116 to engage the wire member 120 as previously explained. Unlike the engagement means 98 wherein "walking" of the front portion of the divider member 96 is controlled by the friction fit between wedge member 108 and flange member 106, use of coupling means 130 and engagement of the teeth 128 with any of the plurality of openings 124 prevents "walking" of the front portion of the divider member 96 over time.

Figure 15:
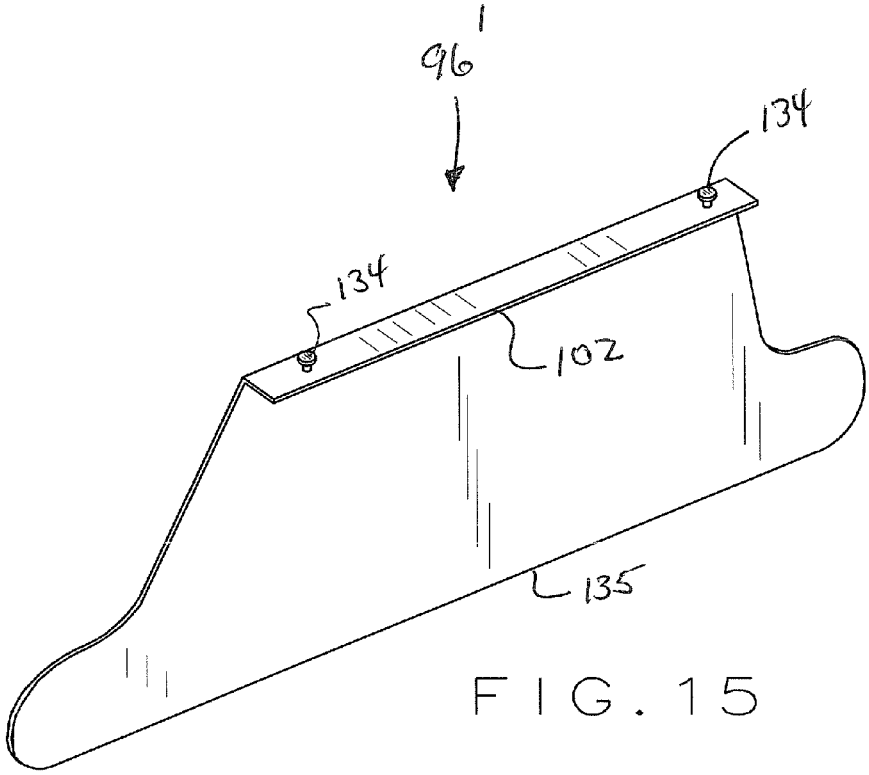
FIG. 15 is a perspective view of one embodiment of an end divider member constructed in accordance with teachings of the present invention.

FIG. 15 illustrates one embodiment of an end divider member 96' which can be removably attached to the opposed side frame members 52 and 54 of each respective shelf member 46. Since the end divider members 96' will be located at the same location with respect to each individual shelf member 46, each end divider member 96' may include a pair of post members 134 which are positioned and located on the top flange member 102 so as to cooperatively engage corresponding keyhole slots 136 associated with both the top and bottom surfaces of each respective shelf side frame member 52 and 54 as best illustrated in FIGS. 6-8 and 11. Like divider members 96, end divider members 96' are positioned and located such that the head portion of each divider post 134 is positioned within the larger opening associated with keyhole slot 136 and, once so positioned, each end divider member 96' is moved forward towards the front of the corresponding shelf member 46 such that the head portion of each respective divider post 134 is moved into position within the narrow slot portion associated with each respective keyhole slot 136. Removal of each end divider member 96' is accomplished in reverse fashion. Since the keyhole slots 136 are located on the shelf frame side members 52 and 54, attachment of end divider members 96' thereto does not interfere with or obstruct the actual floor surface of each respective shelf member 46 thereby providing more usable space for product delivery. Also, importantly, since the keyhole slots 136 are provided on both opposite sides of the side frame members 52 and 54, it is recognized and anticipated that the end divider members 96' could be removably attached to either the shelf member located above a particular shelf member 46 being segregated for product distribution, or such end divider members could be attached to that particular shelf member 46 by inverting the end divider members 96' and attaching such members to the keyhole slots 136 associated with the upper surface of each opposed side frame member 52 and 54 associated with that particular shelf member. This gives a user some versatility and flexibility depending upon the types of products being merchandised from a particular shelf member 46. In addition, instead of inverting the divider member 96' as just explained for attachment to the same shelf member 46, the flange member 102 associated with end divider member 96' illustrated in FIG. 15 could be repositioned and formed along the bottom edge portion 135 of end divider member 96'. In this regard, the shape and size of the end divider member 96' can vary and can take on any shape and size based upon the type of products to be merchandised from the shelf members 46, 46', and/or 46".

It is also recognized and anticipated that the shelf divider members 96 with attachment means 98 and 100 associated therewith can likewise be utilized as end divider members for any particular shelf member 46 by merely attaching such divider members to the front and rear bar engaging members 60 and 70 of tire shelf member located thereabove at the opposed side ends of the shelf member as previously explained.

Figure 21:
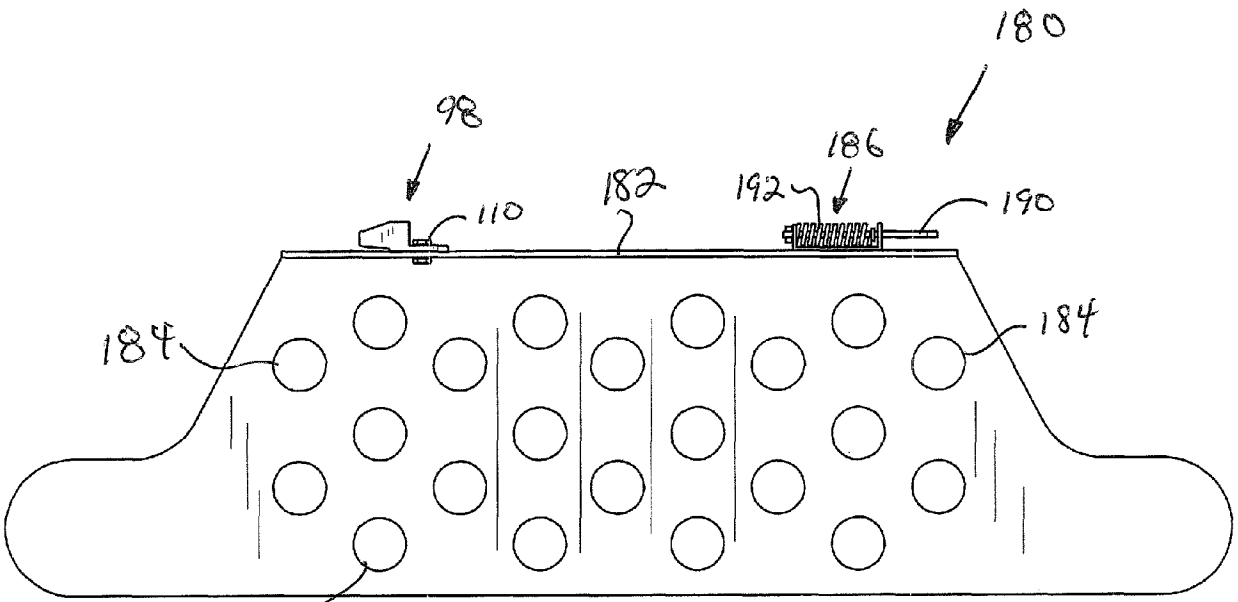
FIG. 21 is a side elevational view of another embodiment of a shelf divider member constructed in accordance with the teachings of the present invention.
Figure 23:
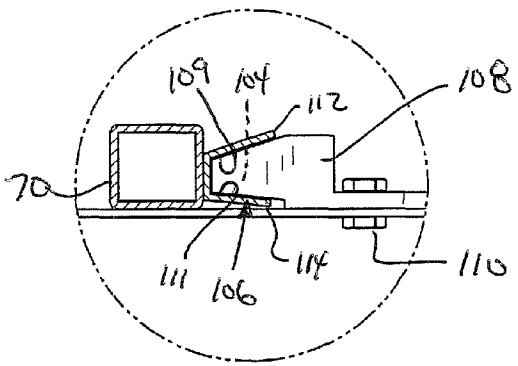
FIG. 23 is a fragmentary side elevational view showing the rear engagement means of the divider member of FIG. 21 engaged with corresponding means associated with the present shelf members.
Figure 22:
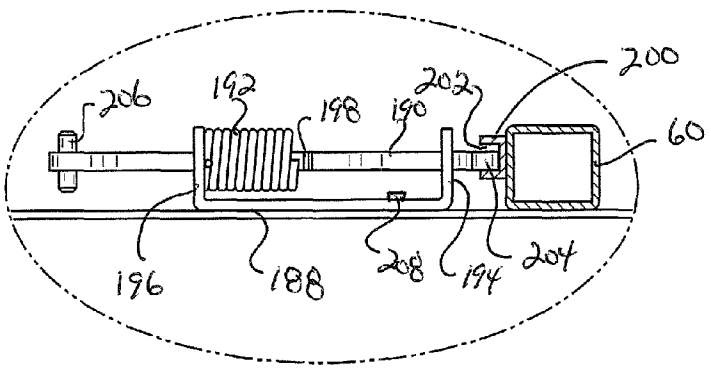
FIG. 22 is a fragmentary side elevational view showing the front engagement means of the divider member of FIG. 21 engaged with corresponding means associated with the present shelf members.

FIGS. 21-23 illustrate still another engagement mechanism for removably attaching and engaging a shelf divider member 180 along the transversely positioned front and rear bar engaging members 60 and 70. In this particular embodiment, the shelf divider member 180 includes front engagement means 186 and rear engagement means 98 associated with the top flange portion 182 of each respective shelf divider member 180. As best illustrated in FIG. 22, the front engagement means 186 is a spring divider guide plunger assembly which includes a guide bracket 188, a plunger member 190 and a biasing member or load spring 192. The guide bracket 188 is substantially U-shaped in configuration having upstanding wall portions 194 and 196 each having a slot (not visible) associated therewith for receiving opposite end portions of the plunger member 190 therethrough. The plunger member 190 is shaped and dimensioned so as to extend through the spring member 192 and may include a lip or flange portion 198, or any other suitable holding means, for engaging and holding one end portion of the spring member 192 in a substantially fixed position therealong. As best shown in FIG. 22, one end portion of the spring member 192 is biased against the flange portion or other means 198 located at an intermediate location along the plunger member 190, and the opposite end portion of the spring member 192 is held and biased against bracket sidewall portion 196. The front bar engaging member 60 associated with the underside portion of each respective shelf member includes a U-shaped flange member 200 having a slot or cavity 202 associated therewith adapted for receiving the front end portion 204 of the plunger member 190. The U-shaped flange member 200 can be formed or otherwise attached to the front bar engaging member 60 by any suitable means and the member 200 extends substantially the full length of member 60. In addition, the front end portion 204 of the plunger member 190 may likewise be elongated in shape in a direction along the slot or cavity 202 so as to provide additional contact area for holding the plunger 190 within the cavity 202. In this regard, the cavity 202 is shaped and dimensioned so as to receive the front end portion 204 of the plunger member 190 and hold such plunger member within the cavity 202 when engaged therewith. The rear end portion of the plunger member 190 located on the outside portion of the bracket member 188 includes a stop member 206 positioned and located so as to prevent the plunger member 190 from exiting the slot associated with bracket sidewall member 196. The bracket member 188 may be integrally formed with the top portion 182 of shelf divider member 180, or bracket member 188 could be fixedly attached to the top flange member 182 by any suitable means such as through the use of rivets or other fastening means 208.

As clearly shown in FIG. 22, the front portion 204 of plunger member 190 can be easily and quickly positioned within the flange member 200 at any location along the full length of the front transverse bar member 60. Once the front end portion 204 of plunger member 190 is engaged with the cavity 202, further movement of the divider member 180 in a forward direction towards front bar engaging member 60 will allow the plunger member 190 to move in a rearward direction thereby compressing spring member 192 between the bracket sidewall 196 and the flange means or other means 198 associated with plunger member 190. This biasing force exerted by spring member 192 will function to hold the divider member 180 in its proper position between the front and rear bar engaging members 60 and 70 as will be hereinafter explained with respect to the rear engagement means 98 associated with divider member 180.

As clearly shown in FIGS. 21 and 23, the rear divider member attachment means 98 is substantially identical to the front engagement means 98 discussed above with respect to divider member 96 except that it is positioned in a rearward direction as clearly illustrated. As best illustrated in FIG. 23, the rear bar engaging member 70 associated with the underside portion of each respective shelf member includes a cavity 104 formed by a flange member 106 which is formed with or otherwise attached to the rear bar member 70. The cavity 104 of flange member 106 is again adapted to receive the wedge member 108 which is positioned and located on the top flange portion 182 of the divider member 180 towards the rear portion thereof as illustrated. The engagement of the wedge member 108 with the flange member 106 is identical to that previously described with respect to FIGS. 10 and 12 except that such engagement occurs after the front engagement means 186 is engaged with the cavity 202 associated with flange member 200. As previously explained, the angular orientation of the top and bottom wedge portions 109 and 111 helps to guide the wedge member 108 into the cavity 104 and the engagement of wedge portions 109 and 111 with the tapers associated with the flange leg portions 112 and 114 likewise serve to frictionally hold the wedge member 108 within the flange member 106. In addition, the biasing force generated by spring member 192 likewise serves to push and hold the wedge member 108 within flange member 106 as will be hereinafter explained.

Once the front portion 204 of plunger member 190 is positioned within the flange member 200, the divider member 180 can be moved and further adjusted along the length of the front bar engaging member 60 until it is positioned at the proper location wherein, at that time, the spring member 192 can be fully or sufficiently compressed by further forward movement of the divider member relative to the front bar member 60 to allow the wedge member 108 to be received within flange member 106. Once the spring member 192 is sufficiently compressed, the rear engagement means 98 is then raised into engagement with the rear bar engaging member 70 as previously explained. Fully or sufficiently compressing the spring member 192 allows the wedge member 108 to be positioned in alignment with flange member 106 and relieving the forward force or pressure of the plunger member 190 against flange member 200 will allow the spring member 192 to exert a biasing force in the rearward direction thereby exerting a force on wedge member 108 so as to drive and hold wedge member 108 within flange member 106. This biasing force exerted by spring member 192 serves to lock and hold that particular shelf divider member 180 in position along the width of any particular shelf member. In essence, the spring member 192 exerts a biasing force in both the rearward and forward directions thereby holding both the wedge member 108 and the plunger member 190 within their respective flange members 106 and 200. As with divider member 96, since the flange members 106 and 200 extend substantially the full length of the front and rear bar engaging members 60 and 70, any plurality of shelf divider members 180 can be positioned and locked into place so as to provide differently spaced product channels with respect to the particular shelf member positioned therebelow. Also, divider member 180 includes a plurality of openings 184 which serve as means for allowing cool circulated air generated inside a typical walk-in cooler to be more easily distributed and circulated between the respective shelf divider members as such cool air can easily pass through any plurality of divider members 180 so as to cool the respective products positioned therebetween.

Although several embodiments of the front and rear engagement means 98, 100 and 186 associated with a particular shelf divider member has been disclosed herein, it is recognized and anticipated that a wide variety of different types of front and rear divider attachment means can be utilized so as to removably position each individual shelf divider member 96 and/or 180 at its proper location along the width of a particular shelf member 46 positioned thereabove.

Figure 16:
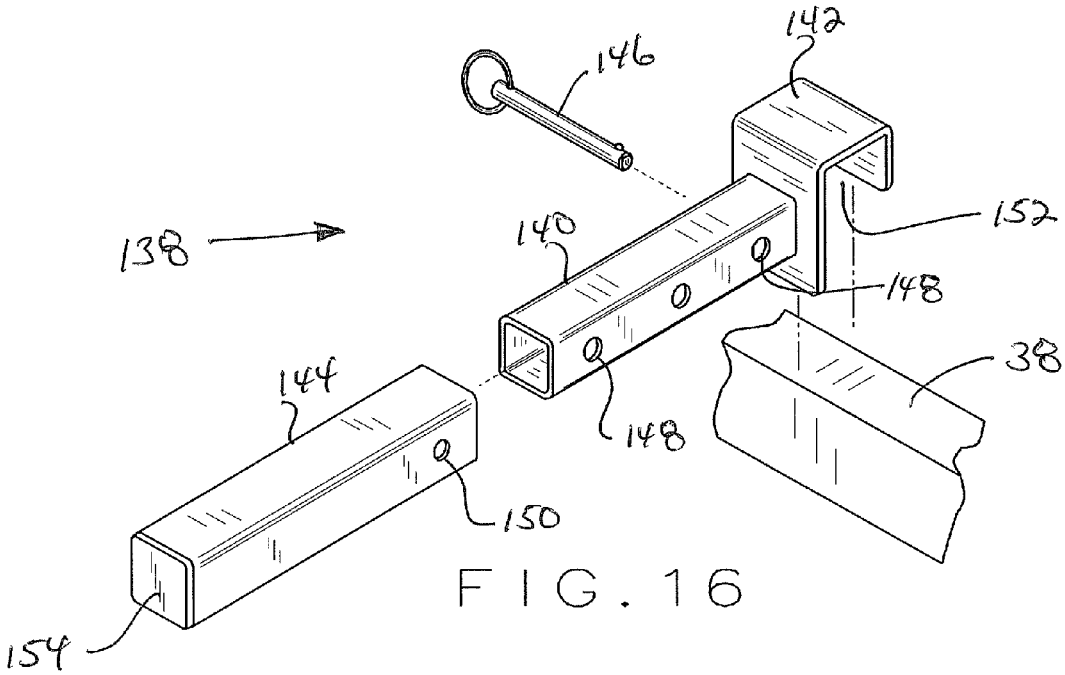
FIG. 16 is an exploded perspective view of a front spacer member constructed in accordance with the teachings of the present invention.

FIG. 16 illustrates an exploded view of a front spacer member which may be optionally used in association with the present system 30 to selectively adjustably control the position of the framework structure 32 and the shelf members 46 relative to the cooler doors 24 when the present product merchandising system 30 is positioned adjacent thereto. Each spacer member 138 includes an elongated member 140 integrally formed with or otherwise attached to an inverted J-shaped flange member 142, an elongated telescoping member 144, and a pin member 146. Elongated member 140 includes a plurality of openings extending therethrough such as the openings 148 for selectively adjustably positioning elongated member 144 in telescopic relationship thereto. In this regard, member 144 includes an opening 150 extending therethrough such that when the member 144 is insertably positioned over member 140, opening 150 can be aligned with any one of the openings 148 to control the overall length of members 140 and 144 relative to flange member 142. Once opening 150 is placed in registration with one of the openings 148, pin member 146 is inserted therethrough to lock and hold the member 144 in telescopic relationship with member 140. The channel opening 152 formed by the inverted J-shaped flange member 142 is sized and shaped so as to cooperatively receive cross-brace members 38 when positioned thereover.

As best illustrated in FIG. 2, any plurality of front spacer members 138 can be positioned in cooperative engagement with the top and bottom cross-brace members 38 associated with the front portion of the merchandising system 30 and elongated member 144 can be telescopically position relative to member 140 to achieve a predetermined distance such that when the overall system 30 is positioned adjacent a cooler door 24, the terminal end portion 154 of each respective spacer member 138 will engage the interior front wall surface 14 of cooler 10 (FIG. 1) so as to control the distance between both the front upright support members 34 and front wall portion of each respective shelf member 46 relative to a closed cooler door 24. In this regard, depending upon the angular orientation of each respective shelf member 46 as well as the type of products being positioned thereon, a user can selectively adjust and control the set back distance of each respective shelf member 46 relative to a corresponding cooler door 24. Flange member 142 can be positioned anywhere along the length of the cross-brace members 38 and the size of the channel opening 152 relative to the size and shape of the cross-brace members 38 should be such that a substantially type friction fit is achieved so as to prevent movement of each respective front spacer member 138 along the length of cross-brace member 38 when in use. Although any plurality of front spacer members may be used in any particular application, as illustrated in FIG. 2, it is contemplated that a pair of front spacer members 138 positioned on the top and bottom cross-brace members 38 respectively as illustrated in FIG. 2 will achieve the stated purpose.

It is also recognized that attachment means can be provided for holding and attaching each unit 30 in proper position to the interior front wall 14 of cooler 10 to further secure such units adjacent a respective cooler door 24. This attachment means can take the form of a tether or other member (not shown) attached both to the interior of the cooler front wall 14 and the unit 30. Other attachment means are also envisioned.

Figure 17:
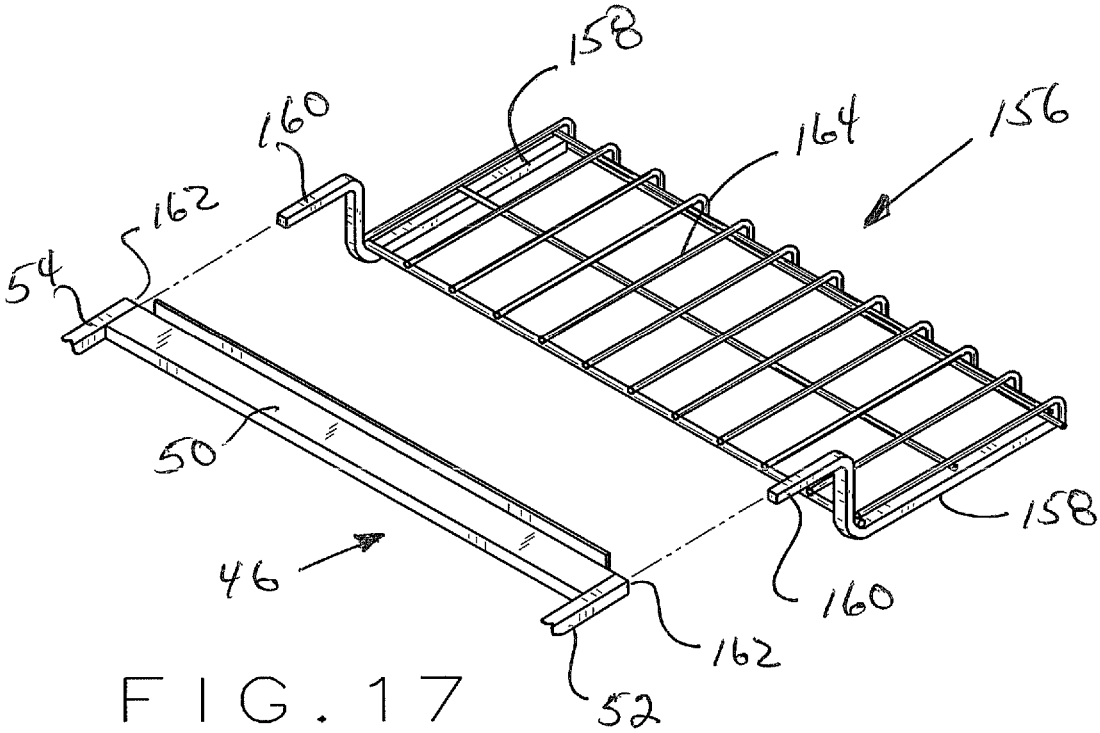
FIG. 17 is an exploded perspective view of a work tray constructed in accordance with the teachings of the present invention, the work tray being cooperatively engageable with the rear portion of one of the present shelf members.

FIG. 17 illustrates an optional work tray or stock shelf member 156 which is cooperatively engageable with the rear end portion of each respective shelf member 46 for allowing a stock person the ability to place new product or cases of products on the work tray 156 in close proximity to a particular shelf member 46 for loading or restocking that particular shelf member or adjacent shelf members. Work tray 156 includes a pair of opposed side frame members 158 each including an extension member 160 which is shaped and dimensioned for being cooperatively inserted and received within the openings 162 associated with each opposed side frame member 52 and 54 associated with each respective shelf member 46. Extension members 160 are of sufficient length such that when the members 160 are inserted within the rear portion of shelf side frame members 52 and 54 through the openings 162, the work tray 156, with product positioned thereon, is adequately supported. As can be seen in FIG. 17, the extension members 160 are vertically offset from the side frame members 158 such that when the work tray 156 is engaged with a particular shelf member 46, the main support surface 164 is positioned below the product support surface or floor of that particular shelf member 46 to be loaded so as to allow a user to stock product on work tray 156 and still have clear access to the rear portion of shelf member 46 for loading and restocking such shelf member. Although the main support surface 164 of work tray 156 is illustrated as a wire grid support surface, it is recognized and anticipated that the support surface 164 can take on a wide variety of different sizes and shapes including a continuous flat supporting floor surface. Once a particular shelf member 46 has been restocked, the work tray 156 can be easily and quickly disengaged and removed from the openings 162 associated with a particular shelf member 46 and the work tray 156 can then be reengaged with a different shelf member 46 for accomplishing the same task. Other structures and configurations for work tray 156 are likewise contemplated and anticipated so long as work tray 156 is selectively removably engageable with the rear portion of each shelf member 46.

As best shown in FIGS. 2 and 3, the work tray 156 can be easily stored in an out-of-the-way position towards the top of the product merchandising system 30 through the use of engagement means associated with the upper portion of each respective rear upright support member 36. In the particular embodiment illustrated in FIGS. 2 and 3, this engagement means includes a respective tubular member 166 positioned and located on the inside portion of each respective upright support member 36, the extension members 160 associated with the work tray 156 being cooperatively receivable and engageable within the openings associated with tubular members 166. With the work tray 156 stored at the top of the unit 30, additional shelf dividers 96 and 96' and other system components such as additional front spacer members 138 can be easily and conveniently stored on the work tray 156. Also, in this regard, such additional system components can likewise be stored on the top portion of the uppermost shelf member 46 associated with any particular system or unit 30. It is also recognized and anticipated that a tubular member 166 could likewise be positioned and located on the inside portion of each respective upright support member 34 as illustrated in FIGS. 2 and 3.

Figure 18:
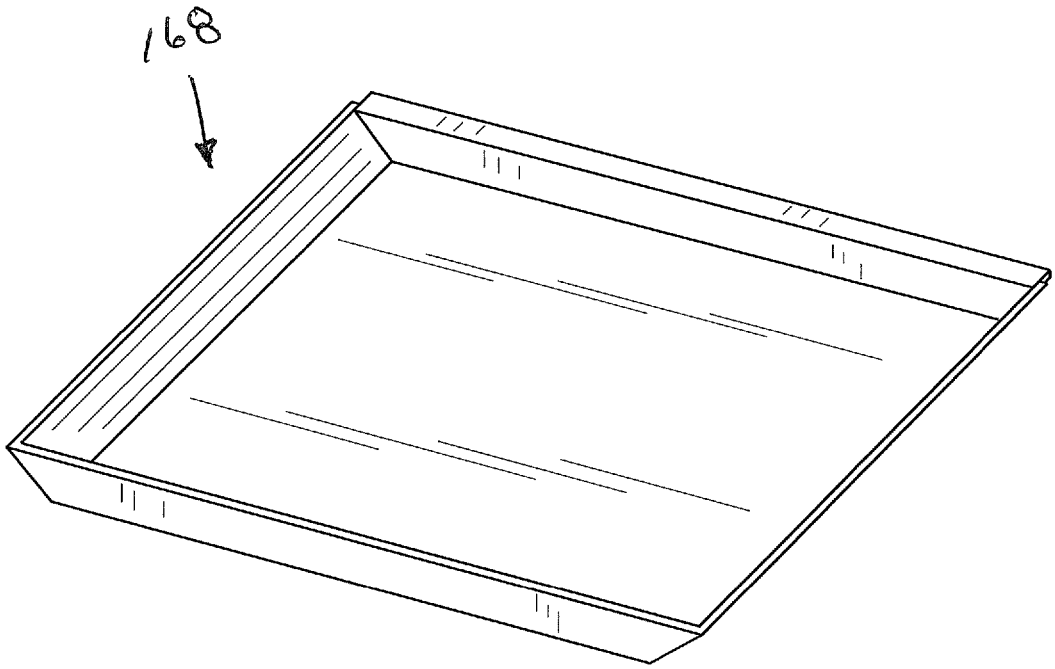
FIG. 18 is a perspective view of a drip pan which can be used with the product merchandising system of FIG. 2.
Figure 19:
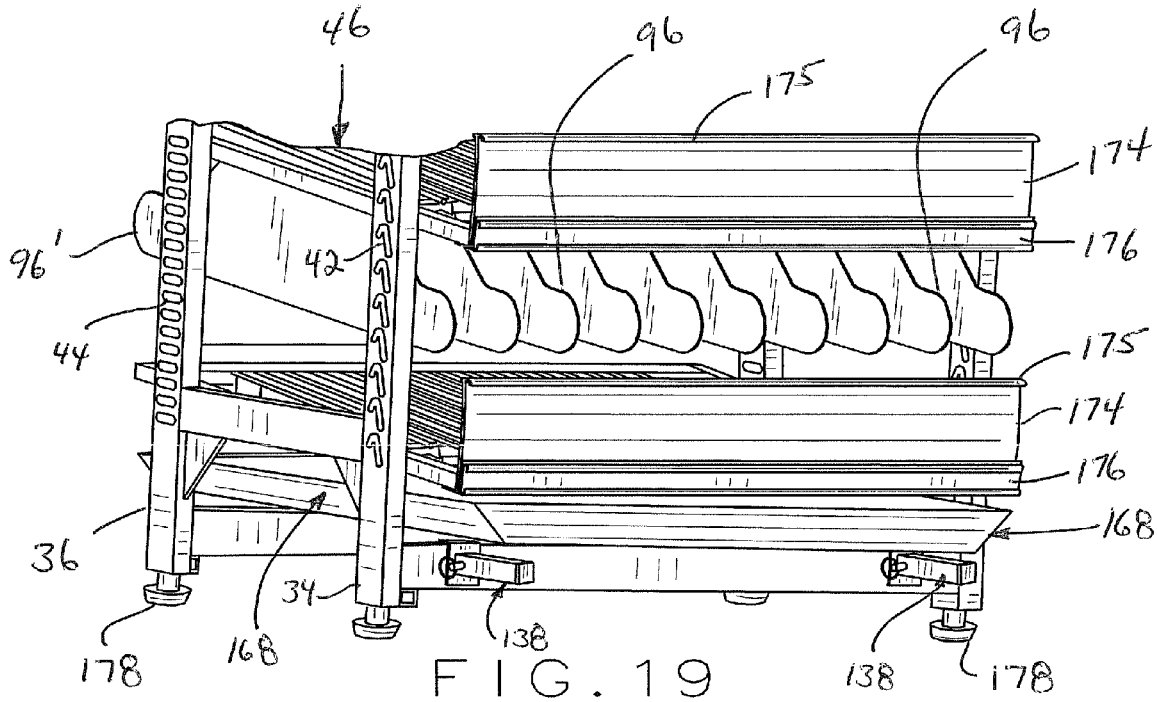
FIG. 19 is a partial perspective view of the lower portion of the product merchandising system of FIG. 2 showing installation of the present drip pan.

FIGS. 18 and 19 illustrate the construction and use of an optional drip pan or catch pan 168 which can be conveniently positioned at the bottom of the frame work structure 32 underneath the lowermost shelf member 46 to catch spillage and any glass breakage during normal use of the present system 30. The drip pan 168 can take on a wide variety of different shapes (FIG. 18) but it should be able to fit between the lowermost shelf member 46 and the front and rear cross-brace members 38 as illustrated in FIG. 19. In this regard, the drip pan 168 merely rests upon the cross-brace members 38 and can be slidably positioned fore and aft relative to the framework structure 32 depending upon the orientation and inclination of the shelf members 46. The drip pan 168 can be easily and quickly slidably positioned and removed from its resting position on top of cross-brace members 38 from the rear of the unit 30. Use of the drip pan 168 will allow for easy and quick clean-up of any spillage or breakage of product containers during normal use and will eliminate spillage onto the interior floor surface 20 of the cooler 10 itself. It is also recognized and anticipated that the drip pan 168 could merely sit on the floor or other support surface underneath the entire unit 30 such as on the cooler floor 20.

Figure 20:
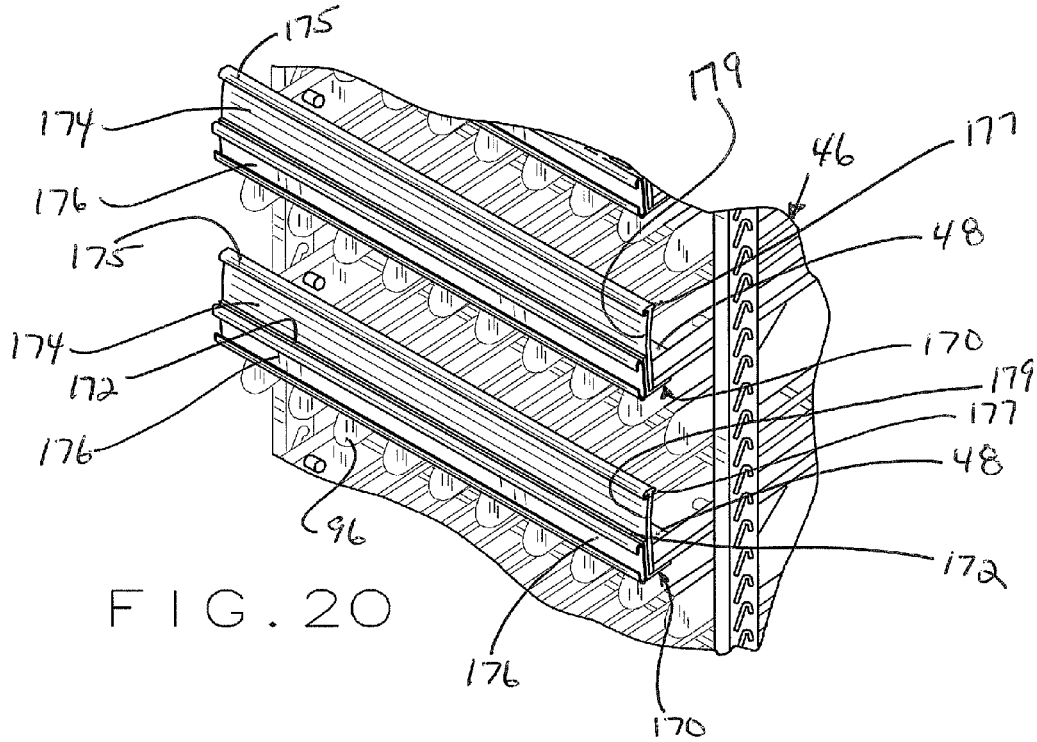
FIG. 20 is a partial perspective view of the top portion of the product merchandising system of FIG. 2 showing the front wall stop member associated with each respective shelf member.

As best illustrated in FIGS. 6 and 20, the front portion of each respective shelf member 46 includes an L-shaped flange member 170 having an upstanding wall portion 172 associated therewith which can function as a front wall stop member depending upon the size of the particular products being merchandised from a particular shelf member 46. The flange member 170 can be attached to the underside portion of front transverse shelf member 48 and its corresponding side frame members 52 and 54 by any suitable means, the upstanding front wall portion 172 being spaced from the front edge portion of frame member 48 by a predetermined distance. This spacing allows a removably attachable product stop or front wall member 174 as best illustrated in FIG. 20 to be removably attachable to the front portion of each respective shelf member 46 so that front walls of different heights can be made interchangeable at the store depending upon the type of products being merchandised from each particular shelf member 46. In this regard, the size and thickness of the front wall member 174 is such that it can be frictionally engaged with the slot or space formed between the front wall portion 172 and the front edge portion of shelf frame member 48. The front product stop or wall member 174 can be provided in varying heights so that a user can easily and quickly selectively interchange a front product stop member 174 of the appropriate height based upon the type of products being merchandised from that particular shelf member 46. The front product stop members 174 can also be provided as a see-through or clear wall member so as not to obstruct or obscure the view of the various products positioned therebehind. Also, as clearly illustrated in FIG. 20, a conventional price channel 176 is attached to or otherwise integrally formed with the upstanding wall portion 172 of flange member 170 to provide for quick and easy change out of product and pricing information associated with each individual shelf member 46. Still further, it is also recognized and anticipated that the shape of the front product stop member 174 can take on a wide variety of different shapes such as a curved design that curves back into the products positioned therebehind as illustrated at 179 in FIG. 20. In addition, the upper end portion of the front wall member 174 may include a barb or other projection 177 projecting back towards the rear of the shelf member and towards the products positioned therebehind, this projection 177 serving as an additional stop means and preventing the upfront product from toppling over the front wall member 174. Use of the barb or projection 177 also allows for the entire height of the product stop member 174 to be reduced since the barb 177 functions to prevent the upfront product, when sliding down the full length of an empty product channel, from toppling over the front wall member 174. Still further, the product stop member 174 could be tinted, etched, routed or otherwise made to match the color or packaging associated with the products positioned therebehind.

It is also recognized and anticipated that the front product stop member 174 may likewise include a channel member 175 located adjacent the top portion and extending along the full length thereof as best illustrated in FIGS. 19 and 20. This additional channel member 175 provides additional flexibility to a user in that it allows for a larger product and/or pricing information panel to be associated with the front portion of each respective shelf member. For example, product indicia or pricing information can be associated with a panel member which would be engageable on one end portion thereof with the lower channel associated with the conventional price channel 176 and on its opposite end portion with the channel member 175. This allows the indicia panel member to be larger than the panel member used with the conventional price channel 176. In addition, a product and/or pricing information panel member could have its lower edge portion engageable with the space or slot formed between the upper channel associated with member 176 and the front product stop member 174 and it could have its upper edge portion engageable with the channel member 175. This allows for an indicia panel member larger than the panel member used with the price channel 176 but smaller than the previously described panel member attached between the lower channel of member 176 and channel member 175. This, in effect, gives a user three different options as to the size of any product and/or price indicia panel member that a user wants to display in front of each respective shelf member 46 when the front product stop member 174 is being utilized.

It is further recognized and anticipated that the overall frame work structure 32 illustrated in FIGS. 2 and 3 can likewise be free standing without any casters and without any mobility. In this regard, the bottom end portions of the upright support members 34 and 36 can merely rest upon a supporting floor surface, or such members can include traditional feet members, including adjustable feet members, such as the feet members 178 illustrated in FIG. 19, which would be cooperatively engageable or otherwise associated with the bottom end portions of the respective upright support members 34 and 36.

Although the present product merchandising system 30 has been described with respect to use in a walk-in type cooler environment, it is recognized and anticipated that the present system 30 could be utilized in any product merchandising application where products are being displayed and offered for sale to the general public. The present system also has utility and other applications such as storing applications where products are stored and held for re-stocking purposes or for other use at a later date and the present system has utility in providing easy access to a wide variety of different types of goods other than food and beverage products.

Although it is recognized that various acceptable materials of construction are available and could equally be employed to fabricate the various components of the present system 30, it is usually preferred that such components such as the framework structure 32, the shelf members 46, and the divider members 96, 96' and 180 be fabricated from certain metals or other durable materials such as certain other metal alloys which are able to withstand moderate impact and mishandling and supply the necessary strength and rigidity depending upon the particular application and the load carrying capacity desired. It is also recognized that certain relatively strong plastic materials as well as other types of materials may likewise be used in fabricating some, if not all, of the components of the present system 30 so long as such materials are able to withstand the desired load carrying capacity of such units.

It is also important to note that the overall dimensions of the present system 30 as well as the configuration of many of the individual components associated therewith including shelf members 46, 46' and 46" and divider members 96, 96' and 180 are subject to wide variations and may be sized and shaped into a variety of different sizes and shapes and configurations so as to be compatible with the size and shape of the particular product merchandising area into which the present system 30 may be employed, or to conform with any other space limitations, without impairing the teachings and practice of the present invention.

The present system 30 thus provides for a product merchandising system having a plurality of individually adjustable shelf members which can be quickly and easily maneuvered and adjusted to achieve any particular product orientation including a substantially flat horizontal shelf orientation as well as gravity feed orientations, and which system provides for a plurality of shelf divider members which can be selectively adjustable to accommodate differently sized products, and which are attachable to the shelf member located thereabove thereby enabling the actual floor space associated with each individual shelf member to be a single continuous floor uninterrupted or uninhibited with any type of divider walls or other protrusions or projections which would interfere with product positioning and location. Still further, when the casters 39 or other wheel means are associated with the merchandising unit 30, the present units 30 can be used as part of a shuttle system for quickly changing out products within the cooler space, or within any other product merchandising area, once product depletion occurs. In this regard, one or more complete systems 30 could be fully loaded and held in abeyance until other units 30 positioned adjacent a particular cooler door, or in other product merchandising areas, are emptied or partially emptied. Change-out is easily accomplished by rolling the empty or partially emptied unit(s) away from the cooler door(s), or away from the other product merchandising area(s), and thereafter immediately positioning a previously restocked unit(s) 30 in the appropriate product merchandising area(s) for immediate access by customers. When mobile, the product merchandising units 30 are freely movable into and out of any product merchandising storage area such as the storage area associated with a cooler space, or from one location to a second location, when desired for loading and for presenting products to customers. Loading or restocking can take place in the interior storage space of a particular cooler, if desired, or such loading and restocking can take place in other back door areas. As a direct result of its mobility, the present system allows for a quick change-out of preferred products as a function of the time of day, or simply to replace sold out product.

Still further, it is also recognized and anticipated that since the plurality of openings 42 and plurality of slots 44 extend through or are located on both opposite side walls of the front and rear upright support members 34 and 36, a single stand-alone system comprising a plurality of the units 30 can be constructed within a cooler 10, or elsewhere, so as to be fixedly attached or otherwise secured or positioned with respect to the cooler floor and cooler doors without any mobility. In this particular embodiment, each adjacent unit 30 would share a front and rear upright support member 34 and 36 with an adjacent unit 30. In other words, the framework structure associated with a free-standing version of the present system without any casters or other mobility across a plurality of five cooler doors could be constructed with a total of six front upright support members 34 and six rear upright support members 36. Other configurations, if necessary, depending upon the spacing between each respective cooler door, is likewise anticipated.

Thus, there has been shown and described several embodiments of a product merchandising system for use in association with walk-in type coolers and with other existing product merchandising areas, which system fulfills all of the objects and advantages sought therefore. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the present invention are deemed to be covered by the invention which is limited only by the claims which follow.

The invention claimed is:

1. A product merchandising unit comprising:

a framework structure having a plurality of upright support members, each upright support member having a plurality of openings associated therewith;

at least one shelf member adjustably positionable along the length of said plurality of upright support members, said at least one shelf member including a plurality of pin members, said plurality of pin members including a pair of pin members mounted towards the rear of said at least one shelf member and a pair of pin members mounted towards the front of said at least one shelf member, said pin members being movable between an extended position and a retracted position and being engageable with the openings associated with said upright support members, said pin members being biased towards their extended positions, a cable member associated with each pin member, each cable member being pullable to individually selectively move each pin member independently of the other pin members, movement of the respective cable members independently moving the respective pin members between their extended positions and their retracted positions; and at least one removably attachable shelf divider member for selectively attaching to the underneath portion of said at least one shelf member anywhere along substantially its entire width, said divider member extending downwardly from said at least one shelf member into the product display space of a shelf member located therebelow and having first and second engagement means associated therewith for engaging with corresponding first and second engagement means associated with the underneath portion of said at least one shelf member.

2. The product merchandising unit defined in claim 1 wherein the openings associated with at least some of said plurality of upright support members are in the shape of a candy cane having two different slot cavities associated with each respective candy cane opening, said slot cavities being associated with the opposite end portions of each respective candy cane opening and being vertically spaced from each other thereby providing for two different locations for receiving a pin member associated with said at least one shelf member within a respective candy cane opening.

3. The product merchandising unit defined in claim 1 including at least one spacer member attachable to said framework structure, said at least one spacer member being selectively adjustable to control the overall length thereof so as to control the setback distance of said framework structure relative to a wall or other object.

4. The product merchandising unit defined in claim 1 including a work tray cooperatively engageable with the rear portion of said at least one shelf member.

5. The product merchandising unit defined in claim 4 wherein said at least one shelf member includes opposed side frame members, each shelf side frame member having an opening associated therewith, said work tray including a pair of extension members shaped and dimensioned for being cooperatively received within the openings associated with said shelf side frame members.

6. The product merchandising unit defined in claim 5 wherein said framework structure includes engagement means for cooperatively receiving the extension members of said work tray for storing said work tray when not attached to said at least one shelf member.

7. The product merchandising unit defined in claim 6 wherein said engagement means of said framework structure includes a pair of tubular members.

8. The product merchandising unit defined in claim 1 wherein said at least one shelf member includes a flange member spaced from the front edge portion of said shelf member by a predetermined distance, said flange member having an upstanding wall portion associated therewith which can function as a front wall stop member for products positioned on said shelf member.

9. The product merchandising unit defined in claim 8 wherein said upstanding wall portion includes a price channel having a pair of spaced apart channel members associated therewith, said pair of channel members being adapted for receiving a panel member therebetween.

10. The product merchandising unit defined in claim 8 including a removably attachable front wall portion taller in height than the upstanding wall portion associated with said flange member, said removably attachable front wall portion being engageable with said predetermined space between the upstanding wall portion of said flange member and the front edge portion of said shelf member.

11. The product merchandising unit defined in claim 10 wherein said removably attachable front wall portion includes a channel member located adjacent the top portion thereof.

12. The product merchandising unit defined in claim 9 including a removably attachable front wall portion taller in height than the upstanding wall portion of said flange member, said removably attachable front wall portion being engageable with said predetermined space between the upstanding wall portion of said flange member and the front edge portion of said shelf member, said removably attachable front wall portion having a channel member located adjacent the top portion thereof.

13. The product merchandising unit defined in claim 12 including a panel member extending between the lowermost channel member associated with the price channel of said flange member and the channel member associated with said removably attachable front wall portion.

14. The product merchandising unit defined in claim 12 including a panel member extending between a spaced formed between the uppermost channel member associated with the price channel of said flange member and said removably attachable front wall portion, and the channel member associated with said removably attachable front wall portion.

15. The product merchandising unit defined in claim 1 wherein said shelf member includes a front transverse member and a rear transverse member associated with the underneath portion thereof;

said first engagement means associated with the underneath portion of said at least one shelf member including a cavity associated with said front transverse member extending substantially the full length thereof and said second engagement means associated with the underneath portion of said at least one shelf member including a cavity associated with said rear transverse member extending substantially the full length thereof; and wherein said first engagement means associated with said at least one divider member includes a plunger member adapted for cooperatively engaging the cavity associated with said front transverse member, and wherein said second engagement means associated with said at least one divider member includes a wedge member adapted for cooperatively engaging the cavity associated with said rear transverse member.

16. The product merchandising unit defined in claim 1 wherein said at least one shelf member includes opposed side frame members, each opposed side frame member including a pair of keyhole slots, and an end divider member having a pair of post members associated therewith, said post members being cooperatively engageable with the pair of keyhole slots associated with each opposed shelf side frame member.

17. The product merchandising unit defined in claim 16 wherein each opposed side frame member includes a top and a bottom surface, the top and bottom surfaces of each opposed shelf side frame member including a pair of keyhole slots, said end divider member being engageable with either the top or the bottom surface of each opposed shelf side frame member.

18. The product merchandising unit defined in claim 10 wherein said removably attachable front wall portion includes a projection located adjacent the top portion thereof projecting rearwardly towards the rear of said at least one shelf member.

19. In a product merchandising unit having a plurality of upright support members wherein each upright support member includes a plurality of openings, the improvement comprising a shelf member adjustably positionable along the length of said plurality of upright support members, said shelf member having at least a pair of retractable pin members mounted adjacent the front portion thereof and at least a pair of retractable pin members mounted adjacent the rear portion thereof, said retractable pin members being movable between an extended position and a retracted position and being engageable with the openings associated with said upright support members, biasing means associated with each pin member for biasing each pin member towards its extended position, said biasing means including a spring member associated with each respective pin member, and a separate cable member associated with each respective pin member, movement of each separate cable member selectively moving each respective pin member independently of the other pin members between their respective extended and retracted positions.

20. The improvement defined in claim 19 wherein said shelf member includes opposed side frame members, each side frame member having an opening associated therewith, and a work tray cooperatively engageable with the openings associated with said side frame members.

21. The improvement defined in claim 19 wherein said shelf member includes a flange member spaced from the front edge portion thereof by a predetermined distance, said flange member having an upstanding wall portion associated therewith which functions as a front wall stop member for products positioned on said shelf member.

22. The improvement defined in claim 21 wherein said upstanding wall portion includes a price channel adapted for receiving a panel member having indicia thereon.

23. The improvement defined in claim 21 including a removably attachable front wall portion taller in height than the upstanding wall portion associated with said flange member, said removably attachable front wall portion being engageable with the predetermined space between the upstanding wall portion of said flange member and the front edge portion of said shelf member.

24. The improvement defined in claim 19 including at least one removably attachable shelf divider member for selectively attaching to the underneath portion of said shelf member anywhere along substantially its entire width, said at least one divider member extending downwardly from said shelf member into the product display space of a shelf member located therebelow, said at least one divider member having first and second engagement means associated therewith for engaging with corresponding first and second engagement means associated with the underneath portion of said shelf member.

25. A product merchandising unit comprising:

a framework structure having a plurality of upright support members, each of said upright support members having a plurality of openings associated therewith;

at least one shelf member adjustably positionable along the length of said plurality of upright support members, said at least one shelf member including a plurality of pin members, said pin members being movable between an extended position and a retracted position and being engageable with the openings associated with said upright support members, said pin members being biased towards their extended positions, said plurality of pin members including a pair of pin members mounted towards the rear of said at least one shelf member and a pair of pin members mounted towards the front of said at least one shelf member, a cable member associated with each pin member, each cable member being pullable to individually selectively move each pin member independently of the other pin members, movement of the respective cable members independently moving the respective pin members between their extended positions and their retracted positions; and wherein the openings associated with at least some of said plurality of upright support members are in the shape of a candy cane having two different slot cavities associated with each respective candy cane opening, said slot cavities being associated with the opposite end portions of each respective candy cane opening and being vertically spaced from each other thereby providing for two different locations for receiving the pin members associated with said at least one shelf member within a respective candy cane opening; and wherein engagement of said at least one shelf member with one of the slot cavities associated with a particular candy cane opening will position the front edge portion of said shelf member at a different setback distance relative to a particular structure as compared to engaging the at least one shelf member with the other slot cavity associated with the same candy cane opening.

26. The product merchandising unit defined in claim 25 wherein said shelf engagement means includes a plurality of pin members, said pin members being selectively engageable with the two different slot cavities associated with each candy cane opening.

27. The product merchandising unit defined in claim 25 including at least one removably attachable shelf divider member for selectively attaching to the underneath portion of said at least one shelf member anywhere along substantially its entire width, said at least one divider member extending downwardly from said at least one shelf member into the product display space of a shelf member located therebelow, said at least one divider member having first and second engagement means associated therewith for engaging with corresponding first and second engagement means associated with the underneath portion of said at least one shelf member.

28. The product merchandising unit defined in claim 27 including a plurality of removably attachable divider members engageable with said at least one shelf member, said divider members forming a plurality of product channels for guiding and maintaining products positioned on the shelf member located therebelow, said divider members being adjustable along the width of said at least one shelf member for controlling and adjusting the width of each respective product channel.

29. In a product merchandising unit having a plurality of upright support members, each upright support member having a plurality of openings associated therewith, the improvement comprising:

at least one shelf member adjustably positionable along the length of said plurality of upright support members, said at least one shelf member including a plurality of pin members, said pin members being movable between an extended position and a retracted position and being engageable with the openings associated with said upright support members for adjustably positioning said at least one shelf member along the length of said upright support members, said pin members being biased towards their extended positions;

said plurality of pin members including a pair of pin members mounted towards the rear of said at least one shelf member and a pair of pin members mounted towards the front of said at least one shelf member, a cable member associated with each pin member, each cable member being pullable to individually selectively move each pin member independently of the other pin members, movement of the respective cable members independently moving the respective pin members between their extended positions and their retracted positions; and said at least one shelf member including a front transverse member and a rear transverse member associated with the underneath portion thereof; and at least one removably attachable shelf divider member for selectively attaching to the front and rear transverse members of said at least one shelf member anywhere along substantially their entire length, said at least one divider member extending downwardly from said at least one shelf member into the product display space of a shelf member located therebelow and having first and second engagement means associated therewith;

said front and rear transverse members including corresponding first and second means for cooperatively engaging the first and second means associated with said at least one divider member for removably attaching said divider member to said shelf member.

30. The improvement defined in claim 29 wherein said at least one shelf member includes opposed side frame members, each opposed side frame member including a pair of keyhole slots; and at least one end divider member having a pair of post members associated therewith, said post members being cooperatively engageable with the pair of keyhole slots associated with each opposed shelf side frame member.

31. The improvement defined in claim 30 wherein each opposed side frame member includes a top and bottom surface, said top and bottom surfaces of each opposed side frame member including a pair of keyhole slots, said at least one end divider member being engageable with either the top or the bottom surface of each opposed side frame member.

32. The improvement defined in claim 29 wherein said shelf engagement means for engaging said plurality of upright support members includes a plurality of pin members positioned and located for aligning with and engaging said plurality of openings associated with said plurality of upright support members when said at least one shelf member is adjustably positioned therebetween.

33. The improvement defined in claim 29 wherein said means associated with said front transverse member includes a cavity extending substantially the full length thereof, and wherein said first engagement means associated with said at least one divider member includes a plunger member adapted for cooperatively engaging said cavity anywhere substantially along the length thereof.

34. The improvement defined in claim 33 wherein said plunger member is biased by a biasing means.

35. The improvement defined in claim 34 wherein said biasing means includes a spring member.

36. The improvement defined in claim 29 wherein said means associated with said rear transverse member includes a cavity extending substantially the full length thereof, and wherein said second engagement means associated with said at least one divider member includes a wedge member adapted for cooperatively engaging said cavity anywhere substantially along the length thereof.

* * * * *